US012345125B2

(12) United States Patent
Peters

(10) Patent No.: US 12,345,125 B2
(45) Date of Patent: Jul. 1, 2025

(54) CONNECTION MEMBERS INCLUDING SHAPE MEMORY MATERIALS, DOWNHOLE TOOLS INCLUDING THE CONNECTION MEMBERS, AND METHODS OF FORMING THE DOWNHOLE TOOLS

(71) Applicant: Baker Hughes Oilfield Operations LLC, Houston, TX (US)

(72) Inventor: Volker Peters, Celle (DE)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/459,069

(22) Filed: Aug. 31, 2023

(65) Prior Publication Data

US 2024/0229601 A1 Jul. 11, 2024

Related U.S. Application Data

(60) Provisional application No. 63/374,190, filed on Aug. 31, 2022.

(51) Int. Cl.
*E21B 34/06* (2006.01)

(52) U.S. Cl.
CPC ..... *E21B 34/06* (2013.01)

(58) Field of Classification Search
CPC ..... E21B 34/06; E21B 17/041
See application file for complete search history.

(56) References Cited

U.S. PATENT DOCUMENTS 4,297,779 A 11/1981 Melton et al.
5,058,936 A 10/1991 Kapgan et al.
5,779,281 A 7/1998 Kapgan et al.
6,388,043 B1 5/2002 Langer et al.
9,458,717 B2 10/2016 Fechte-Heinen et al.
10,280,479 B2 5/2019 Yu et al.
(Continued)

OTHER PUBLICATIONS

Mohammed Y. Abdellah; Stress Distribution and Fracture Toughness of Underground Reinforced Plastic Pipe Composite; 2021 MDPI.com; p. 1—abstract.*
(Continued)

*Primary Examiner* — Cathleen R Hutchins
*Assistant Examiner* — Ronald R Runyan
(74) *Attorney, Agent, or Firm* — TraskBritt

(57) ABSTRACT

A downhole valve system for use in a borehole is disclosed. The downhole valve system includes a first downhole component formed of a brittle material, a second downhole component, and a connection member. The connection member formed from a shape memory material and includes: an outer surface including an outer diameter; an inner surface including an inner diameter, one of the outer and inner diameter modifiable by applying a stimulus to the shape memory material; and a connection feature, complimentary of a connection feature of the second downhole component, formed on one of the outer surface and the inner surface. The connection member secured to the first downhole component at a corresponding surface of the one of the inner and outer diameter and to the second downhole component via the first connection feature and the second connection feature to connect the second downhole component to the first downhole component.

20 Claims, 12 Drawing Sheets

(56) References Cited

U.S. PATENT DOCUMENTS

| | | | | |
|---|---|---|---|---|
| 10,557,579 | B2 | 2/2020 | Zaragoza Labes et al. | |
| 2004/0012198 | A1* | 1/2004 | Brotzell | F16L 47/04 285/249 |
| 2004/0182580 | A1* | 9/2004 | Moore | E21B 23/08 166/382 |
| 2008/0005887 | A1 | 1/2008 | Glenn et al. | |
| 2009/0277579 | A1 | 11/2009 | Marelli et al. | |
| 2014/0248011 | A1* | 9/2014 | Sottiaux | F03G 7/065 384/221 |
| 2018/0010400 | A1 | 1/2018 | Thomas et al. | |
| 2018/0073303 | A1 | 3/2018 | Bilen et al. | |
| 2018/0363812 | A1 | 12/2018 | Fritskey et al. | |
| 2022/0205336 | A1 | 6/2022 | Asthana et al. | |

OTHER PUBLICATIONS

Wang et al., Martensitic Transformation Involved Mechanical Behaviors and Wide Hysteresis of NiTiNb Shape Memory Alloys, Progress in Natural Science: Materials International (2012), vol. 22, No. 2, pp. 130-138.

International Search Report for Application No. PCT/US2023/073212 dated Jan. 26, 2024, 5 pages.

International Written Opinion for Application No. PCT/US2023/073212 dated Jan. 26, 2024, 5 pages.

* cited by examiner

CONNECTION MEMBERS INCLUDING SHAPE MEMORY MATERIALS, DOWNHOLE TOOLS INCLUDING THE CONNECTION MEMBERS, AND METHODS OF FORMING THE DOWNHOLE TOOLS

CROSS-REFERENCE TO RELATED APPLICATION

This application claims the benefit under 35 U.S.C. § 119(e) of U.S. Provisional Patent Application Ser. No. 63/374,190, filed Aug. 31, 2022, the disclosure of which is hereby incorporated herein in its entirety by this reference.

TECHNICAL FIELD

Embodiments of the present disclosure generally relate to shape memory materials. In particular, embodiments of the present disclosure relate to connection members including shape memory material, downhole tools including the connection members, and methods of forming the downhole tools.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using one or more earth-boring tool(s), such as an earth-boring rotary drill bit, secured to a series of elongated tubular segments connected end-to-end in what is referred to in the art as a "drill string." During drilling operations, the drill string extends from an uphole end at a surface of a drilling rig down to the earth-boring tool (e.g., the drill bit) at the downhole end of the drill string. The earth-boring rotary drill bit is rotated and advanced into the subterranean formation. As the earth-boring rotary drill bit rotates, the cutting elements, cutters, or abrasive structures thereof cut, crush, shear, and/or abrade away the formation material to form the wellbore. As formation material is removed from the wellbore, the wellbore elongates. Additional tubular segments may be sequentially added to the uphole end of the drill string to maintain contact of the earth-boring tool with the bottom of the wellbore.

A downhole end of the drill string at the bottom of the wellbore being drilled generally includes an assembly of tools and components often referred to in the art as a "bottom-hole assembly" (BHA). The BHA generally includes one or more downhole tools to detect information about the drilling process, evaluate the formation being drilled, and relay that information to the surface in real-time. The downhole tool(s) may be positioned within the interior of and secured to a tubular element of the drill string, such as a drill collar. For example, a downhole tool may be positioned within a subassembly or a drill collar that may be coupled to additional tubular segments of the drill string, such as additional drill collars, subassemblies, drill pipe, downhole motors, etc.

During drilling operations, drilling fluid is pumped from the drilling rig down through the center of the drill string, often through a downhole motor, out from nozzles of the drill bit, and circulates through the wellbore back to the drilling rig. Since downhole tools are often positioned within the drill string and come in direct contact with the drilling fluid circulating through the drill string, downhole tools may be made of materials that are resistant to abrasion and corrosion.

BRIEF SUMMARY

Embodiments described herein include shape memory material structures, downhole tools including shape memory materials, and methods of forming downhole tools that include shape memory materials.

In one illustrative embodiment, the present disclosure provides a connection member including a body including a shape memory material configured to transition from a first state having a first configuration to a second state having a second configuration in response to application of a stimulus. The body includes one or more sidewalls and a connection feature. The one or more sidewalls define an opening extending between ends thereof. The connection feature is on at least a portion of the one or more sidewalls. The connection feature includes the shape memory material and is configured to couple the body to a component while in the first state.

In another illustrative embodiment, the present disclosure provides a downhole valve system for use in a borehole. The downhole valve system includes a first downhole component, a second downhole component, and a connection member. The first downhole component made from a brittle material includes a longitudinal axis. The second downhole component includes a first connection feature. The connection member formed from a shape memory material and includes: an outer surface including an outer diameter; an inner surface including an inner diameter, one of the outer diameter and the inner diameter modifiable by applying a stimulus to the shape memory material; and a second connection feature, complimentary of the first connection feature, formed on one of the outer surface and the inner surface. The connection member secured to the first downhole component at a corresponding surface of the one of the inner diameter and the outer diameter and to the second downhole component via the first connection feature and the second connection feature to connect the second downhole component to the first downhole component.

In a further illustrative embodiment, the present disclosure provides a downhole valve system for use in a borehole. The downhole valve system includes a first downhole component, a second downhole component, and a connection member. The first downhole component made from a brittle material includes a longitudinal axis. The connection member formed from a shape memory material and includes: an outer surface including an outer diameter and an inner surface including an inner diameter. One of the outer diameter and the inner diameter modifiable by applying a stimulus to the shape memory material. The connection member secured to the first downhole component at a first corresponding surface of the one of the inner diameter and the outer diameter, and the connection member secured to the second downhole component at a second corresponding surface of the one of the inner diameter and the outer diameter to connect the second downhole component to the first downhole component.

In yet another illustrative embodiment, the present disclosure provides a method of forming a downhole tool. The method includes providing a first downhole component made from a brittle material and including a longitudinal axis and a second downhole component including a first connection feature. The method also includes connecting the second downhole component to the first downhole component with a connection member formed from a shape memory material. The connection member including: an outer surface including an outer diameter; an inner surface including an inner diameter, one of the inner diameter and the outer diameter modifiable by applying a stimulus to the shape memory material; and a second connection feature, complimentary of the first connection feature, formed on one of the outer surface and the inner surface, the connection formed by securing the connection member to the first downhole component at a corresponding surface of the one of the inner diameter and the outer diameter and connecting the connection member to the second downhole component via the first connection feature and the second connection feature to connect the second downhole component to the first downhole component.

DETAILED DESCRIPTION

Figure 1:
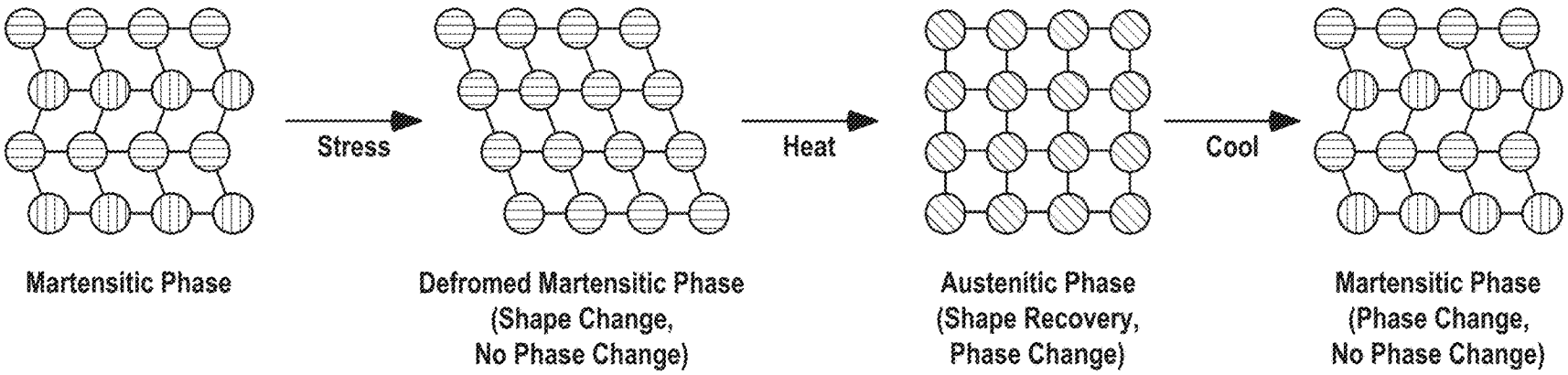
FIGS. 1 and 2 are simplified diagrams illustrating how the microstructure of a shape memory material may change, in accordance with embodiments of this disclosure.

Certain structures, such as components of downhole tools, may be made of materials that are generally durable in terms of high hardness, resistant to erosion, corrosion, and abrasion, and also lightweight due to a relatively low density. Materials exhibiting desirable properties for certain downhole tool applications may also be relatively brittle and include materials such as ceramics or hard metal. While the chemical and thermal resistance of brittle materials, such as ceramics, makes them attractive materials for many applications, brittle materials are generally difficult to machine in comparison to metals. In addition, it may be desirable to connect brittle structures to one or more additional structures to form an assembly. For example, downhole tools generally include a variety of components that are connected together before being positioned within the drill string. Thus, the difficulty to machine brittle materials presents challenges for connecting brittle structures to other structures of an assembly. For example, it is difficult manufacture a thread in a brittle material. Even though it may be possible to manufacture a thread in a hard metal, this thread would not provide a reliable mechanical connection due to the missing elastic material properties of the hard metal, required in a threaded connection. To address this issue, metallic connection members, such as sleeves, or threaded sleeves, can be machined to size and then press-fit onto the ceramic material by first heating the metallic sleeve for thermal expansion. However, structures designed for a press-fit or interference fit require precision machining and procedures that are prone to error.

Thus, in accordance with embodiments of this disclosure, connection members may include a shape memory material configured to transition from a first state having a first configuration to a second state having a second configuration, and vice versa, in response to application of a stimulus, such as a temperature, stress (optical stress, magnetic stress, or mechanical stress), or electrical current. The connection members may exhibit super-elastic properties, which may facilitate connections between brittle structures (e.g., ceramic, hard metal, glass, graphite, etc.) without press-fit or gluing procedures. For example, the shape memory material of the connection member may be in a second state below a transition temperature, and an opening within the connection member may be enlarged such that the connection member can be positioned on a brittle structure. Once positioned in a desired location, the connection member may be exposed to a temperature above the transition temperature. Exposing the connection members to a temperature above the transition temperature initiates a state change from the second state back to the first state, and results in a change in volume and configuration (e.g., shape, such as shrinking or expending) to secure the connection member to the brittle structure. The connection member may then be machined to form a connection feature (e.g., threads) that can be used to secure the brittle structure to another structure of the downhole tool. In certain embodiments, the connection member may be machined to form the connection feature before securing the connection member to the brittle structure. In other embodiments, instead of exposing the connection member to a temperature above the transition temperature, a stress or an electrical current may be used to initiate the change from the second state back to the first state.

The following description provides specific details, such as specific shapes, specific sizes, dimensions, specific material compositions, and specific processing conditions, in order to provide a thorough description of embodiments of the present disclosure. However, a person of ordinary skill in the art will understand that the embodiments of the disclosure may be practiced without necessarily employing these specific details. Embodiments of the disclosure may be practiced in conjunction with conventional fabrication techniques employed in the industry. In addition, the description provided below does not form a complete process flow for manufacturing a connection member or a downhole tool. Only those process acts and structures necessary to understand the embodiments of the disclosure are described in detail below. Additional acts to form a complete connection member or a complete downhole tool from the structures described herein may be performed by conventional fabrication processes and additive manufacturing processes.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the singular forms "a," "an," and "the" are intended to include the plural forms as well, unless the context clearly indicates otherwise.

As used herein, the term "and/or" includes any and all combinations of one or more of the associated listed items.

As used herein, the term "substantially" in reference to a given parameter, property, or condition means and includes to a degree that one of ordinary skill in the art would understand that the given parameter, property, or condition is met with a degree of variance, such as within acceptable tolerances. By way of example, depending on the particular parameter, property, or condition that is substantially met, the parameter, property, or condition may be at least 90.0 percent met, at least 95.0 percent met, at least 99.0 percent met, at least 99.9 percent met, or even 100.0 percent met.

As used herein, the term "about," when used in reference to a numerical value for a particular parameter, is inclusive of the numerical value and a degree of variance from the numerical value that one of ordinary skill in the art would understand is within acceptable tolerances for the particular parameter. For example, "about," in reference to a numerical value, may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, the term "shape memory material" includes any suitable shape memory material, including shape memory metal alloys and shape memory polymers. Shape memory metal alloys may include Ni-based alloys, Cu-based alloys, Co-based alloys, Fe-based alloys, Ti-based alloys, Al-based alloys, or any mixture thereof. Shape memory metal alloys may additionally include additional elements, such as Niobium (Nb), which may enhance the shape memory capability of such materials. For example, a shape memory metal alloy may include a 50:50 mixture by weight of nickel and titanium, a 55:45 mixture by weight of nickel and titanium, or a 60:40 mixture by weight of nickel and titanium. Many other compositions are possible and can be selected based on tool requirements and material properties as known in the art. Shape memory polymers may include, for example, epoxy polymers, thermoset polymers, thermoplastic polymers, or combinations or mixtures thereof. Other polymers that exhibit shape memory behavior may also be employed. Shape memory materials are polymorphic and may exhibit two or more crystal structures or states (e.g., phases). Shape memory materials may further exhibit a shape memory effect associated with the state (e.g., phase) transition between two crystal structures or states (e.g., phases), such as austenite and martensite. The austenitic phase exists at elevated temperatures, while the martensitic phase exists at low temperatures. The shape memory effect may be triggered by a stimulus that may be thermal, electrical, magnetic, or chemical, and which causes a transition from one solid state to another.

As used herein, the terms "brittle structure" and "brittle material" refer to materials that have low ductility and, at 20° C., undergo 5% or less elongation (i.e., tensile plastic deformation) before fracturing when tested in accordance with ASTM Test Method under ASTM E399 using a tensile testing machine. The definition of a brittle material as used in this application refers to material that possess a fracture toughness or crack resistance $K_{1C}$ lower than 20 $MPa \cdot m^{1/2}$. As specific non-limiting examples, "brittle structures" and "brittle materials" include ceramics, glasses, graphite, certain metals (hard metals) and alloys, certain polymers, polycrystalline diamonds, etc. Ceramics may be Silicone Nitrides, Silicone Carbides, Aluminum Oxides, Zirconium Oxid or alternative technical ceramics. Hard metals may be Tungsten Carbide, Titanium Carbide, Titanium Nitride, or Tantalum Carbide.

Figure 2:
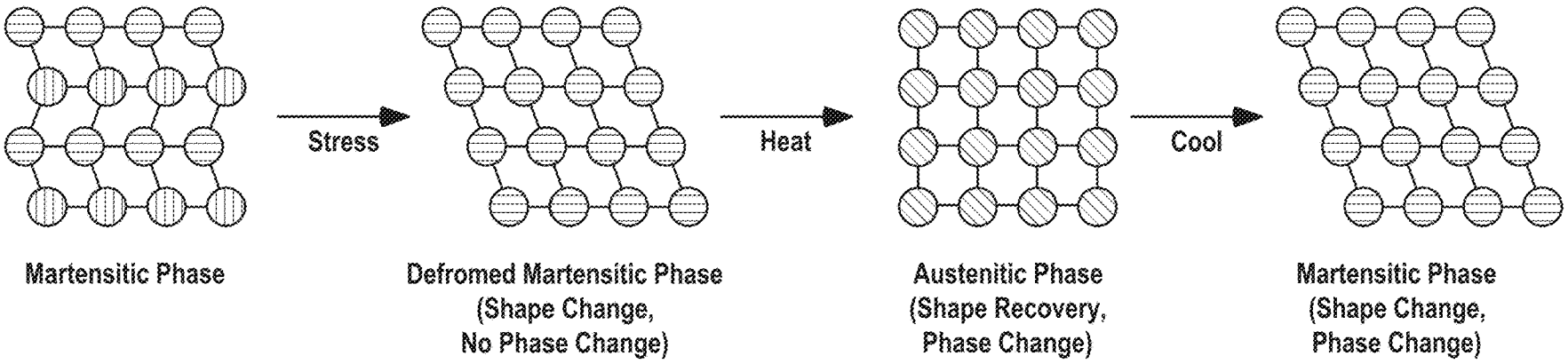

FIGS. 1 and 2 are simplified diagrams illustrating how the microstructure of a shape memory material may change. While FIGS. 1 and 2 specifically illustrate microstructure of shape memory alloys, shape memory polymers may exhibit a similar shape memory effect, as described below. Shape memory materials generally exhibit both a "shape memory effect" and a "pseudoplasticity effect." Described briefly, the shape memory effect refers to the ability of a material to reverse material deformation in response to a temperature-induced state (e.g., phase) transformation. The pseudoelasticity effect refers to the ability of a material to reverse material deformation in response to a stress-induced state (e.g., phase) transformation, such as induced by the application of an external load.

Referring now to FIG. 1, a shape memory alloy may transform from an original austenitic phase (i.e., a high-temperature phase) to a martensitic phase (i.e., a low-temperature phase) upon cooling. The phase transformation from austenite to martensite may be spontaneous, diffusionless, and temperature dependent. The transition temperatures from austenite to martensite and vice versa vary for different shape memory alloy compositions. For example, the material composition of the shape memory alloy may be selected and/or tailored such that a first transition temperature (e.g., martensite finish temperature ($M_f$)) of a shape memory alloy occurs within a range of from about −140° C. to about 0° C., and a second transition temperature (e.g., austenite finish temperature ($A_f$)) of the shape memory alloy occurs within a range of from about 0° C. to about 200° C. Different material compositions of shape memory alloys and the transition temperatures are described in Minjuan Wang et al., *Martensitic transformation involved mechanical behaviors and wide hysteresis of NiTiNb shape memory alloys,* 22(2) Progress in Natural Science: Materials International 130-138 (2012), available: sciencedirect.com/science/article/pii/S1002007112000330, the entire contents of which is hereby incorporated herein by this reference.

The phase transformation from austenite to martensite occurs between a first temperature ($M_s$), at which austenite begins to transform to martensite and a second, lower temperature ($M_f$), at which only martensite exists. As shown in FIG. 1, initially, the crystal structure of martensite is heavily twinned and may be deformed by an applied stress such that the material takes on a new size and/or shape. After the applied stress is removed, the material retains the deformed size and/or shape. However, upon heating, martensite may transform and revert to austenite. The phase transformation occurs between a first temperature ($A_s$) at which martensite begins to transform to austenite and a second, higher temperature ($A_f$) at which only austenite exists. Upon a complete transition to austenite, the element returns to its original "remembered" size and/or shape. As used herein, the term "remembered" refers to a configuration to which a material returns spontaneously responsive to a temperature change. Upon a second cooling process and transformation from austenite to martensite, the crystal structure of the martensitic phase is heavily twinned and may be deformed by an applied stress such that the material takes on at least one of a new size and/or shape. The size and/or shape of the material in the previously deformed martensitic phase are not remembered from the initial cooling process. This shape memory effect may be referred to as a one-way shape memory effect, such that the element exhibits the shape memory effect only upon heating as illustrated in FIG. 1.

Other shape memory alloys possess two-way shape memory, such that a material comprising such a shape memory alloy exhibits this shape memory effect upon heating and cooling. Shape memory alloys possessing two-way shape memory effect may therefore, include two remembered sizes and shapes—a martensitic (i.e., low-temperature) shape and an austenitic (i.e., high-temperature) shape. Such a two-way shape memory effect is achieved by "training." By way of example and not limitation, the remembered austenitic and martensitic shapes may be created by inducing non-homogeneous plastic strain in a martensitic or austenitic phase, by aging under an applied stress, or by thermomechanical cycling. With reference to FIG. 2, when a two-way shape memory alloy is cooled from an austenitic to a martensitic phase, some martensite configurations might be favored, so that the material may tend to adopt a preferred shape. By way of further non-limiting example, and without being bound by any particular theory, the applied stress may create permanent defects, such that the deformed crystal structure of the martensitic phase is remembered. After the applied stress is removed, the element retains the deformed size and/or shape. Upon heating, martensite may transform and revert to austenite between the first temperature ($A_s$) and the second, higher temperature ($A_f$). Upon a complete transition to austenite, the element returns to its original remembered size and shape. The heating and cooling procedures may be repeated such that the material transforms repeatedly between the remembered martensitic and the remembered austenitic shapes.

In some embodiments, the shape memory alloy material may comprise a nickel-titanium-niobium alloy that includes from about 40% to about 60% nickel by atomic weight, from about 30% to about 40% titanium by atomic weight, and from about 5% to about 20% Niobium by atomic weight. As specific non-limiting examples, the shape memory alloy may include $Ni_{47.5}Ti_{47.5}Nb_5$, $Ni_{45}Ti_{44}Nb_9$, and/or $Ni_{45}Ti_{45}Nb_{10}$. In some embodiments, the first temperature ($M_f$), at which only martensite exists may be about −40° C., and the higher temperature ($A_f$) at which only austenite exists may be about 10° C. By way of non-limiting example, the shape memory alloy or shape memory polymer in a downhole application is to be selected to ensure that for a typical downhole temperature range, such as around 1° C. to around 250° C., or 1° C. to around 350° C., the shape memory alloy or shape memory polymer is in the austenite phase. The material properties of the shape memory alloy or shape memory polymer are to be selected to allow a desired change in the dimension in the martensitic phase.

A shape memory polymer may exhibit a similar shape memory effect. Heating and cooling procedures may be used to transition a shape memory polymer between a hard solid state and a soft solid state by heating the polymer above, for example, a melting point or a glass transition temperature ($T_g$) of the shape memory polymer and cooling the polymer below the melting point or glass transition temperature ($T_g$) as taught in, for example, U.S. Pat. No. 6,388,043, issued May 14, 2002, and titled "Shape Memory Polymers," the entire disclosure of which is incorporated herein by this reference. The shape memory effect may be triggered by a stimulus which may be thermal, electrical, magnetic, or chemical.

Figure 3:
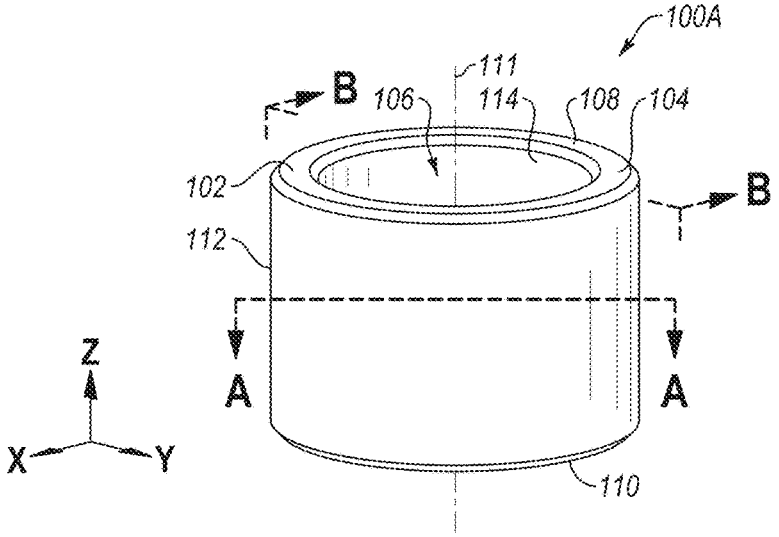
FIG. 3 is a simplified perspective view of a connection member in a first state and unmodified configuration, in accordance with embodiments of this disclosure.
Figure 4:
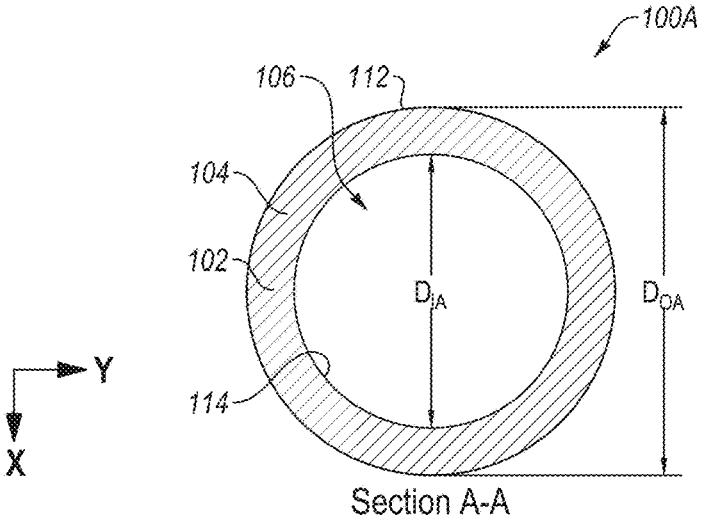
FIGS. 4 and 5 are simplified cross-sectional views of the connection member of FIG. 3 taken along the A-A plane (FIG. 4), and taken along the B-B plane (FIG. 5), in accordance with embodiments of this disclosure.
Figure 5:
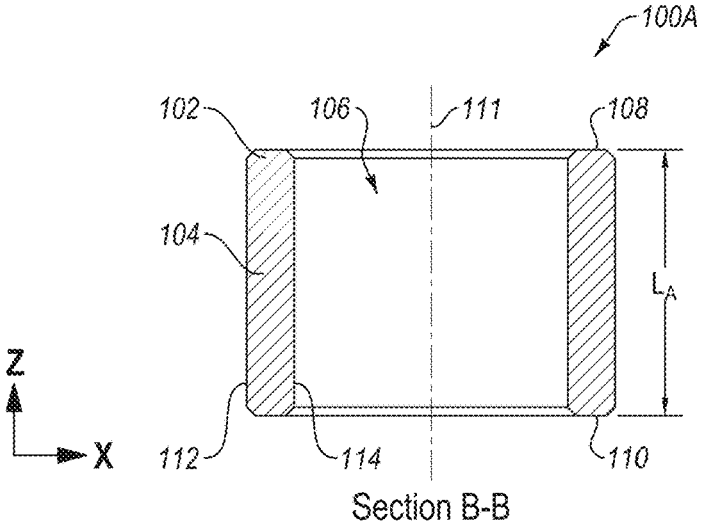

FIGS. 3-5 are a simplified perspective view (FIG. 3), a simplified cross-sectional view (FIG. 4), and another simplified cross-sectional view (FIG. 5) of a connection member 100A in a first state and "permanent" or unmodified configuration, in accordance with embodiments of this disclosure. FIG. 4 is a simplified cross-sectional view of the connection member 100A taken along the A-A plane, and FIG. 5 is a simplified cross-sectional view of the connection member 100A taken along the B-B plane.

The connection member 100A may be used to secure a brittle structure (e.g., brittle structure 210 (FIG. 10) or brittle structure 310 (FIG. 15)) to one or more additional components to form a downhole tool. The brittle structure may be any structure made of a brittle material, such as a shaft, housing, etc. The brittle structure may be a solid structure, such as a solid cylindrical structure made from a solid material, or may be a structure with an inner bore along the longitudinal axis, such as a tube like structure. A diameter of the inner bore may be less than 30%, less than 20%, less than 10% or less than 5% of an outer diameter of the brittle structure. The connection member 100A may be made of or include a shape memory material, and the brittle structure (e.g., the brittle structure 210 (FIG. 10) and brittle structure 310 (FIG. 15)) may be made of or include a brittle material, such as glass, ceramic, graphite, hard metal, etc. In some embodiments, such as that shown in FIGS. 3-5, the connection member 100A may be in the form of a tubular structure configured (e.g., sized, shaped, oriented, and/or arranged) to surround at least a portion of a brittle material structure. While brittle structures are described, the disclosure is not so limited. For example, the connection members 100A and the processes described herein can be utilized in connection with any type of material structure.

The connection member 100A generally includes a body 102 comprising a shape memory material configured to transition from a first state (e.g., austenite for shape memory alloys, or soft solid state for shape memory polymers) to a second state (e.g., martensite for shape memory alloys, or hard solid state for shape memory polymers) in response to application of a stimulus, such as temperature. The body 102 may include one or more sidewalls 104. In various embodiments, the one or more sidewalls 104 include a cylindrical shape with a singular sidewall (e.g., a hollow cylindrical shape, a right circular hollow cylindrical shape, a tapered circular cylindrical shape, without limitation). The body 102, and in various embodiments, the one or more sidewalls 104, define an opening 106 (e.g., a cavity, through-hole, etc.) within the body 102. In the embodiment shown in FIGS. 3-5, the opening 106 extends from a first end 108 of the body 102 through a second end 110 of the body 102 opposite the first end 108. In some embodiments, the opening 106 may be centered about a central longitudinal axis 111 of the body 102.

A length ($L_A$) of the connection member 100A is defined by a distance from the first end 108 of the body 102 to the second end 110 of the body 102, opposite the first end 108. For example, the length $L_A$ of the connection member 100A is defined by the distance from the first end 108 of the body 102 to the second end 110 of the body 102. The one or more sidewalls 104 may include an exterior surface 112 defining outer dimensions (e.g., an outer diameter ($D_{OA}$)) of the connection member 100A, and an interior surface 114 defining interior dimensions (e.g., an inner diameter ($D_{IA}$)) of the opening 106 within the body 102. The length ($L_A$) and the dimensions (e.g., $D_{OA}$ and/or $D_{IA}$) of the connection member 100A may be selected and/or modified as desired.

Edges of the one or more sidewalls 104 of the body 102 may be chamfered, rounded, beveled, etc., at an end or ends thereof. For example, portions of the one or more sidewalls 104 proximate the exterior surface 112 and/or the interior surface 114 of the body 102 of the connection member 100A may be chamfered, rounded, beveled, etc., at an end or ends thereof. In addition, the portions of the one or more sidewalls 104 at the first end 108 and/or the second end 110 of the body 102 may be chamfered, rounded, beveled, etc. Chamfered, beveled, and/or rounded edges may facilitate relative movement between the connection member 100A and another structure, such as a brittle structure, while sliding the connection member on a corresponding portion of the brittle structure (210, 310).

In FIGS. 3-5, the connection member 100A may be in a first state (e.g., the austenitic phase for shape memory alloys, or the soft solid state for shape memory polymers) and in a "permanent" or unmodified configuration. While the description below primarily references shape memory alloys, substantially the same behavior and processes apply to shape memory polymers by heating above and cooling below the glass transition temperature ($T_g$), rather than heating above the austenite finish temperature ($A_f$) and cooling below the martensite finish temperature ($M_f$). For example, the austenite phase of shape memory alloys may be analogous to the soft solid state of shape memory polymers, the martensite phase of shape memory alloys may be analogous to the hard solid state of shape memory polymers, and the glass transition temperature ($T_g$) of shape memory polymers may be analogous to a combination of the austenite finish temperature ($A_f$) and the martensite finish temperature ($M_f$) of shape memory alloys.

Figure 15:
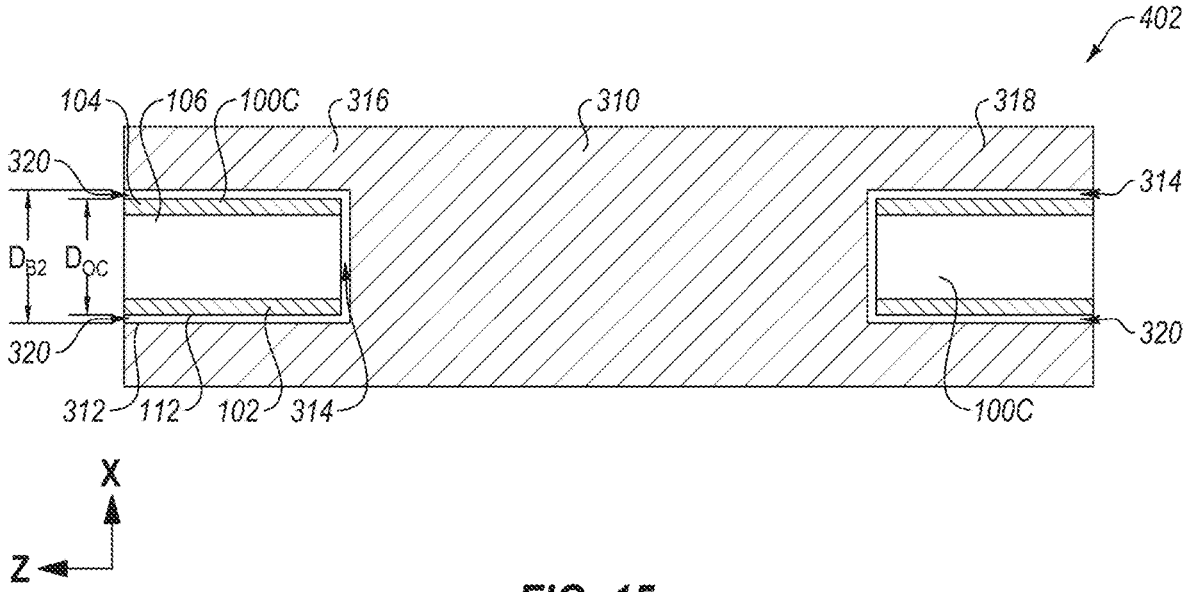
FIG. 15 is a simplified cross-sectional view of two of the connection members of FIG. 8 in the second state and the modified configuration, which are positioned within a brittle structure, in accordance with additional embodiments of this disclosure.

The connection member 100A may be at a temperature above the austenite finish temperature ($A_f$) such that the connection member 100A is in the austenitic phase. The connection member 100A may be at about room temperature (about 20° C.), and the austenite finish temperature ($A_f$) may be about 5° C. In the austenitic phase, the connection member 100A may exhibit one or more dimensions (e.g., inner diameter ($D_{IA}$) or outer diameter ($D_{OA}$)) that would cause an interference fit between the connection member 100A and at least a portion of the brittle structure 210 (FIG. 10) or 310 (FIG. 15). As non-limiting examples, the connection member 100A (in the austenitic phase) may exhibit an inner diameter ($D_{IA}$) within a range of from about 12 mm to about 20 mm (e.g., about 16 mm), an outer diameter ($D_{OA}$) within a range of from about 17 mm to about 25 mm (e.g., about 21 mm), and a length ($L_A$) within a range of from about 12 mm to about 20 mm (e.g., about 16 mm).

In embodiments in which the connection member 100A comprises a shape memory polymer, the connection member 100A may be at a temperature above the glass transition temperature ($T_g$) such that the polymer is in a soft solid state. The connection member 100A may similarly exhibit dimensions (e.g., inner diameter ($D_{IA}$) or outer diameter ($D_{OA}$) that would cause an interference fit between the connection member 100A and at least a portion of the brittle structure 210 (FIG. 10) or the brittle structure 310 (FIG. 15).

In some embodiments, at least a portion of the brittle structure 210 (FIG. 10) is approximately cylindrical and the connection member 100A forms a tubular structure (e.g., a sleeve), the inner diameter ($D_{IA}$) of the opening 106 within the body 102 of the connection member 100A (before a downhole tool including the brittle structure 210 is assembled) may be slightly smaller than the outer diameter of the brittle structure 210 (e.g., a ceramic shaft). For example, the inner diameter ($D_{IA}$) of the opening 106 may be from about 0.005% smaller to about 1% smaller than the outer diameter of the corresponding portion of the brittle structure 210, such as from about 0.05% smaller to about 0.5% smaller than the outer diameter of the corresponding portion of the brittle structure 210. As non-limiting examples of values, the inner diameter ($D_{IA}$) of the opening 106 may be from about 0.001 inch (0.0254 mm) to about 0.1 inch (2.54 mm) smaller than the outer diameter of the corresponding portion of the brittle structure 210, such as from about 0.02 inch (0.508 mm) to about 0.060 inch (1.524 mm) smaller than the outer diameter of the corresponding portion of the brittle structure 210. In some embodiments, the brittle structure 210, and/or the connection member 100A may include ridges or other textured surfaces to improve retention or alignment between the brittle structure 210 and the connection member 100A upon phase transition of the connection member. The inner diameter of connection member 100A defines a surface (surface corresponding to the inner diameter). In the first state and unmodified configuration of connection member 100A, the surface is secured to the corresponding portion of brittle structure 210.

In additional embodiments, the brittle structure 310 (FIG. 15) may be, for example, a brittle housing or a shaft that includes a cavity on one or more ends of the housing or shaft. The cavity may be sized and shaped to receive the connection member 100A, and the connection member 100A forms a tubular structure (e.g., a sleeve) sized and shaped to fit within the cavity of the brittle structure 310, the outer diameter ($D_{OA}$) of the body 102 of the connection member 100A (before the downhole tool including the brittle structure 310 is assembled) may be slightly larger than the inner diameter of the cavity within the brittle structure 310. For example, the outer diameter ($D_{OA}$) of the body 102 of the connection member 100A may be from about 0.005% larger to about 1% larger than the inner diameter of the cavity within the brittle structure 310, such as from about 0.05% larger to about 0.5% larger than the cavity within the brittle structure 310. As non-limiting examples of values, the outer diameter ($D_{OA}$) of the body 102 of the connection member 100A may be from about 0.001 in (0.0254 mm) to about 0.1 in (2.54 mm) larger than the inner diameter of the cavity within the brittle structure 310, such as from about 0.02 in (0.508 mm) to about 0.060 in (1.524 mm) larger than the inner diameter of the cavity of the brittle structure 310. In some embodiments, the brittle structure 310, and/or the connection member 100A may include ridges or other textured surfaces to improve retention or alignment between the brittle structure 310 and the connection member 100A.

Figure 7:
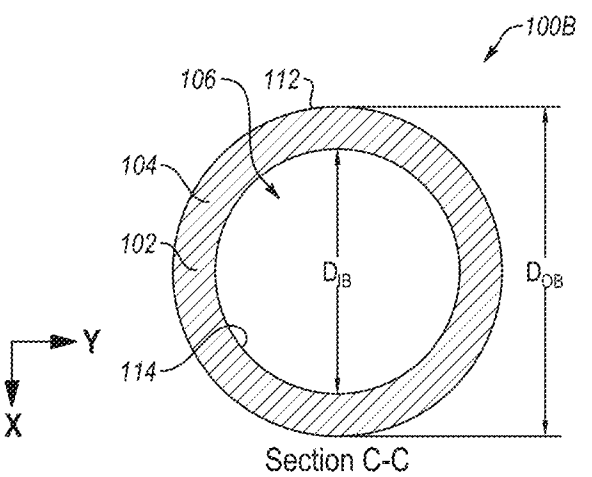
FIG. 7 is a simplified cross-sectional view of the connection member of FIG. 6 taken along the C-C plane, in accordance with embodiments of this disclosure.
Figure 6:
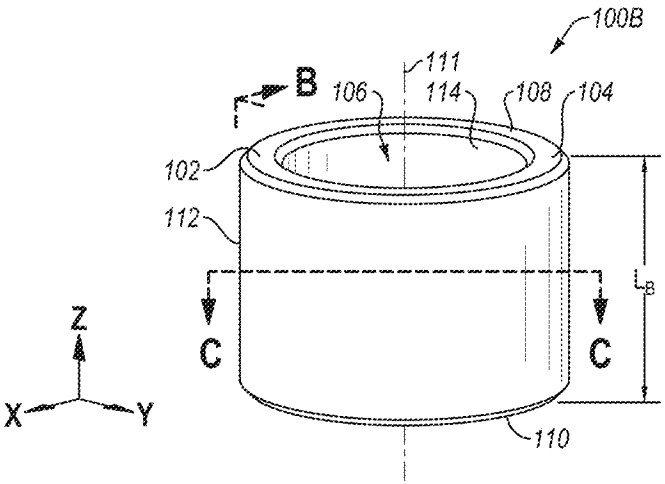
FIG. 6 is a simplified perspective view of the connection member of FIG. 3 in a second, different state and an unmodified configuration, in accordance with embodiments of this disclosure.

In embodiments in which the connection member 100A comprises a shape memory alloy, the connection member 100A may be cooled to a temperature below the martensite finish temperature ($M_f$) for shape memory alloys, such that the connection member 100A changes state (e.g., phase) from austenite (FIGS. 3-5) to martensite (FIGS. 6 and 7, connection member 100B). In embodiments in which the connection member 100A comprises a shape memory polymer, the connection member 100A may be cooled to a temperature below the glass transition temperature ($T_g$), such that the connection member 100A changes state from the soft solid state (FIGS. 3-5) to the hard solid state (FIGS. 6 and 7, connection member 100B).

FIGS. 6 and 7 are a simplified perspective view (FIG. 6) and a simplified cross-sectional view (FIG. 7) of the connection member 100A in a second, different state (100B) and a "permanent" or unmodified configuration (e.g., martensite, without limitation), in accordance with embodiments of this disclosure. FIG. 7 is a simplified cross-sectional view of the connection member 100B of FIG. 6 taken along the C-C plane.

The connection member 100B may be at a temperature below the martensite finish temperature ($M_f$) such that the connection member 100B is in a second, different state (e.g., the martensitic phase), and also in a "permanent" or unmodified configuration. The connection member 100B may be cooled to about −40° C., and the martensite finish temperature ($M_f$) may be about −40° C. In the martensitic phase, the connection member 100B may exhibit substantially the same dimensions as the connection member 100A in the austenitic phase. In the martensitic phase, the dimensions of the connection member 100B (e.g., the inner diameter ($D_{IB}$), the outer diameter ($D_{OB}$), and/or the length ($L_B$)) may be modified by applying stress to the connection member 100B to plastically deform (change dimensions) the martensitic material. For example, the inner diameter ($D_{IB}$), the outer diameter ($D_{OB}$), and/or the length ($L_B$) of the connection member 100B may be increased by, for example, forcing a shaping body made from a hardened material through the opening 106 of the connection member 100B. For example, the hardness of the hardened material of the shaping body may be higher than the hardness of the connection member 100B (e.g., higher than the hardness of the interior surface 114 within the opening 106 of the connection member 100B). As a non-limiting example, the hardness of the hardened material of the shaping body may be greater than about 50 Rockwell C hardness (HRC). In addition, the hardened material has a larger outer diameter than the inner diameter ($D_{IB}$) of the connection member 100B, such that the inner diameter ($D_{IB}$) of the connection member 100B expands as the shaping body passes through the opening 106. The expansion of the opening 106 of the connection member 100B may shift the location of the shape memory material and may correspondingly increase the outer diameter ($D_{OB}$) and/or the length ($L_B$) of the connection member 100B.

In embodiments in which the connection member 100B comprises a shape memory polymer, the connection member 100B may be at a temperature below the glass transition temperature ($T_g$) such that the polymer is in a hard solid state. The connection member 100B may exhibit substantially the same dimensions as the connection member 100A in the soft solid state. In the hard solid state, the dimensions of the connection member 100B (e.g., the inner diameter ($D_{IB}$), the outer diameter ($D_{OB}$), and/or the length ($L_B$)) may be modified by applying stress to the connection member 100B to plastically deform the hard solid state polymer material, in substantially the same manner as discussed with respect to the connection member 100B comprising a shape memory alloy. For example, a shaping body made from hardened material may be passed through (e.g., forced through) the opening 106 of the connection member 100B to expand the inner diameter ($D_{IB}$) and/or to modify the outer diameter ($D_{OB}$) and/or the length ($L_B$) of the connection member 100B. In some embodiments, the shaping body may be forced through the opening 106 along the central longitudinal axis 111 of the body 102 to expand the inner diameter ($D_{IB}$).

Expanding the inner diameter ($D_{IB}$) of opening 106 of the connection member 100B may be done in a single pass or multiple passes with multiple differently sized shaping bodies, depending on the desired resulting size of the inner diameter ($D_{IB}$) of the connection member 100B. For example, a desired final inner diameter ($D_{IB}$) of the opening 106 of the connection member 100B may be about 1.5 mm larger than the current inner diameter ($D_{IB}$) (unmodified configuration) of the connection member 100B. A first shaping body made of a hardened material (e.g., a first hardened steel ball) with a diameter of about 0.5 mm larger than the inner diameter ($D_{IB}$) of the connection member 100B may be forced through the opening 106 such that the inner diameter ($D_{IB}$) expands about 0.5 mm. Next, a second shaping body made of the hardened material (e.g., a second hardened steel ball) that is about 0.5 mm larger than the partially expanded inner diameter ($D_{IB}$) and the first hardened steel ball may be forced through the partially expanded opening 106 such that the partially expanded inner diameter expands about another 0.5 mm, for a total of about 1 mm expansion. Additionally, a third shaping body made of the hardened material (e.g., a third hardened steel ball) that is about 0.5 mm larger than the partially expanded inner diameter ($D_{IB}$) and the second hardened steel ball may be forced through the partially expanded opening 106 such that the partially expanded inner diameter ($D_{IB}$) expands about another 0.5 mm to an expanded diameter ($D_{IB}$), for a total of about 1.5 mm expansion. The expansion of the inner diameter ($D_{IB}$) of the connection member 100B may also correspondingly increase the outer diameter ($D_{IB}$) and/or the length ($L_B$) of the connection member 100B, as shown in FIGS. 8 and 9.

Figure 9:
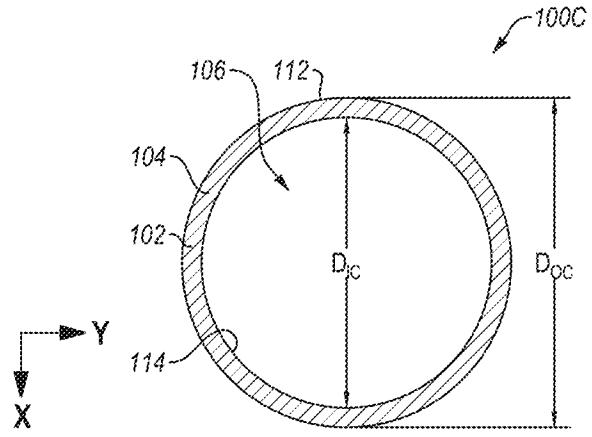
FIG. 9 is a simplified cross-sectional view of the connection member of FIG. 8 taken along the D-D plane, in accordance with embodiments of this disclosure.
Figure 8:
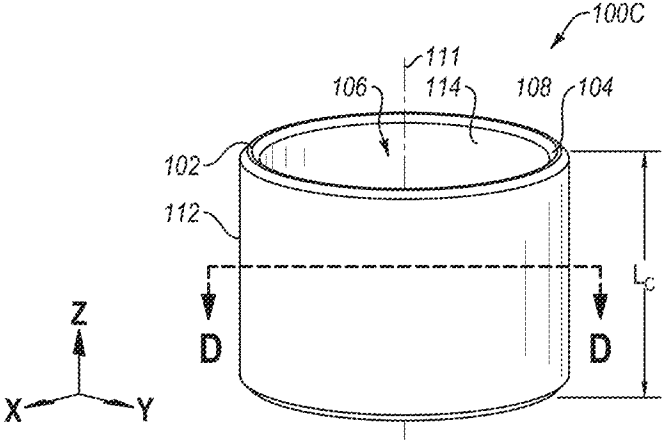
FIG. 8 is a simplified perspective view of the connection member of FIG. 6 in a modified configuration, in accordance with embodiments of this disclosure.

FIGS. 8 and 9 are a simplified perspective view (FIG. 8) and a simplified cross-sectional view (FIG. 9) of the connection member 100B in the second state, but in a modified configuration 100C relative to the connection member 100B, in accordance with embodiments of this disclosure. FIG. 9 is a simplified cross-sectional view of the connection member of FIG. 8 taken along the D-D plane.

In FIGS. 8 and 9, the connection member 100C may remain at a temperature below the transition temperature (e.g., below the martensite finish temperature ($M_f$) for shape memory alloys, or below the glass transition temperature ($T_g$) for shape memory polymers), such that the connection member 100C remains in the second state (e.g., the martensitic phase, or the hard solid state). The dimensions of the connection member 100C, such as the inner diameter ($D_{IC}$) of the opening 106, the length ($L_C$) of the body 102, and optionally the outer diameter ($D_{OC}$) of the body 102 may be different than (e.g., larger, smaller, or substantially the same size as) the corresponding dimensions of the connection member 100B. For example, the inner diameter ($D_{IC}$) may be larger than the inner diameter the inner diameter ($D_{IB}$), the length ($L_C$) may be larger than the length ($L_B$), and/or the outer diameter ($D_{OC}$) may be larger than the outer diameter ($D_{OB}$).

In the second state (e.g., martensitic phase, or hard solid state) and in the expanded configuration, the connection member 100C may exhibit one or more dimensions (e.g., inner diameter ($D_{IC}$) or outer diameter ($D_{OC}$)) that enables the connection member 100C to easily move relative to the corresponding portion of the brittle structure 210 (FIG. 10) so the connection member 100C can be positioned on or within the corresponding portion of the brittle structure 210.

For example, in embodiments in which the brittle structure 210 comprises a shaft including an outer diameter, the inner diameter ($D_{IC}$) of the connection member 100C may be larger than the outer diameter of the brittle structure 210 to easily slide on the shaft. For example, the inner diameter ($D_{IC}$) of the opening 106 of the connection member 100C may be from about 0.005% larger to about 5% larger than the outer diameter of the corresponding portion of the brittle structure 210, such as from about 0.1% larger to about 2% larger than the outer diameter of the corresponding portion of the brittle structure 210. As non-limiting examples of values, the inner diameter ($D_{IC}$) of the connection member 100C may be from about 0.001 in (0.0254 mm) to about 0.1 in (2.54 mm) larger than the outer diameter of the corresponding portion of the brittle structure 210, such as from about 0.01 in (0.254 mm) to about 0.05 in (1.27 mm) smaller than the outer diameter of the corresponding portion of the brittle structure 210.

In embodiments in which the brittle structure 310 comprises a housing or a shaft including a cavity that includes an inner diameter, the outer diameter ($D_{OC}$) of the body 102 of the connection member 100C may be smaller than the inner diameter within the cavity of the brittle structure 310 to easily slide within the cavity. For example, the outer diameter ($D_{OC}$) of the body 102 of the connection member 100C may be from about 0.005% smaller to about 5% smaller than the inner diameter of the cavity within the brittle structure 310, such as from about 0.1% smaller to about 2% smaller than the inner diameter of the cavity within the brittle structure 310. As non-limiting examples of values, the outer diameter (D) of the connection member 100C may be from about 0.001 in (0.0254 mm) to about 0.1 in (2.54 mm) smaller than the inner diameter of the cavity within the brittle structure 310, such as from about 0.01 in (0.254 mm) to about 0.05 in (1.27 mm) smaller than the inner diameter of the cavity within the brittle structure 310.

Figure 10:
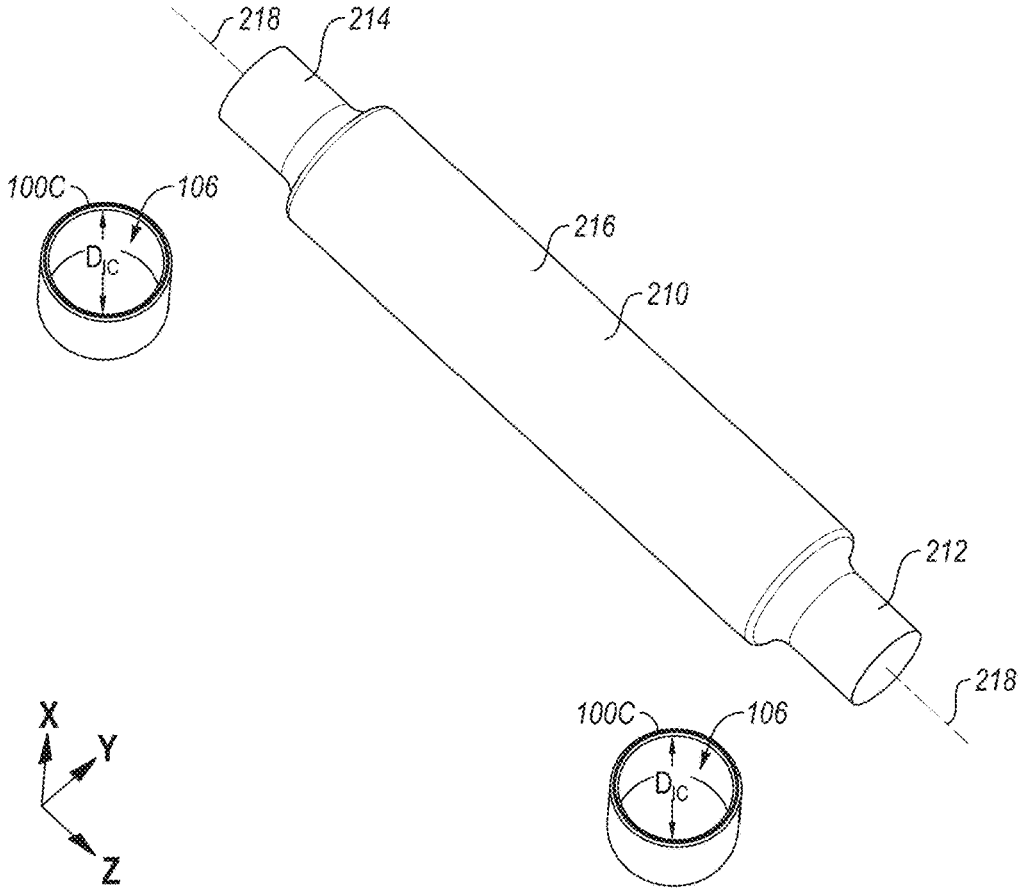
FIG. 10 is a perspective view of a brittle structure and two of the connection members of FIG. 8 that are in the second state and the modified configuration, in accordance with embodiments of this disclosure.

FIG. 10 is a perspective view of a brittle structure 210 and two of the connection members 100C in the second state (e.g., martensitic, or hard solid state) and the modified configuration (e.g., expanded configuration), in accordance with embodiments of this disclosure. The brittle structure 210 may be, for example, a brittle material shaft (e.g., ceramic, hard metal, glass, graphite, etc.) that may form part of a downhole tool. The brittle structure 210 includes a first end portion 212 and an opposite second end portion 214 that are each configured (e.g., sized, shaped, oriented, and/or arranged) to receive one of the connection members 100C. As shown in FIG. 10, a central portion 216 of the brittle structure 210 may exhibit a larger diameter than the first and second end portions 212, 214 of the brittle structure 210. A first diameter of the first end portion 212 may be substantially the same as a second diameter of the second end portion 214. In addition, the first diameter and the second diameter may each be smaller than the inner diameter (D) of the openings 106 within the connection members 100C to facilitate placement of the connection members 100C in the respective first and second end portions 212, 214 of the brittle structure 210. The first and second end portions 212, 214 of the brittle structure 210 are shown as having a substantially constant diameter along a length (L1) of the brittle structure 210 defined by a distance from a first end 212*a* of the first end portion 212 to an opposite end of the second end 212*b* of first end portion 212 (e.g., in a direction parallel to a longitudinal axis 218 of the brittle structure 210). However, in additional embodiments, the first and second end portions 212, 214 may by tapered with radially wider portions proximate ends of the brittle structure. In further embodiments, each of the first and second end portions 212, 214 may include a step feature proximate the respective second end (212*b*) of the brittle structure that flares radially outward relative to a remainder of the respective first and second end portion 212, 214. Wide ends of a taper or wide steps proximate ends of the brittle structure 210 may further mechanically secure the connection members 100C in place for a firm connection. The connection members 100C may be positioned on the first and second end portions 212, 214 of the brittle structure 210, as shown in FIG. 11.

Figure 11:
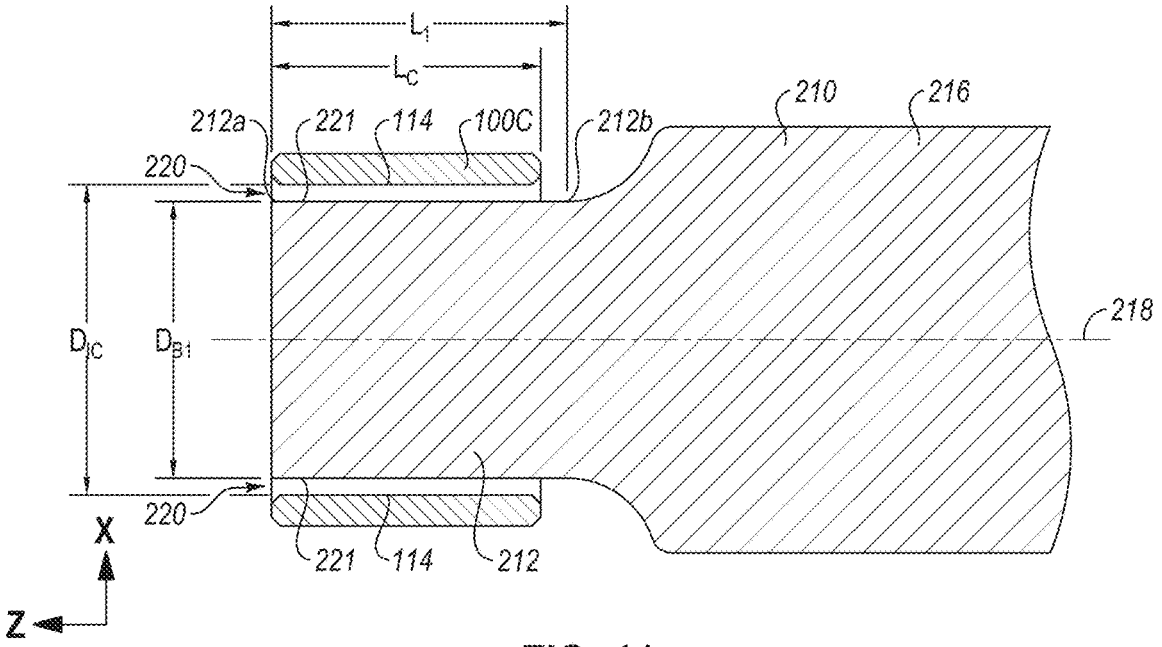
FIG. 11 is a simplified side cross-sectional view of one of the connection members of FIG. 10 positioned on a corresponding portion of the brittle structure of FIG. 10.

FIG. 11 is a simplified side cross-sectional view of one of the connection members 100C of FIG. 10 positioned on the first end portion 212 of the brittle structure 210. The connection member 100C is in the second state (e.g., martensitic, or hard solid state) and the modified configuration. Because the inner diameter ($D_{IC}$) of the opening 106 within the connection member 100C is larger than the outer diameter ($D_{B1}$) of the first end portion 212 of the brittle structure 210, there is clearance 220 between the interior surface 114 of the connection member 100C and an outer surface 221 of the first end portion 212. The clearance 220 is sufficient to move the connection member 100C relative to the first end portion 212 and the brittle structure 210. In the second state the connection member 100C may be positioned to be joined to the first end portion 212 or may be removed from the first end portion 212. To remove the clearance 220 and secure the connection members 100C to the first and second end portions 212, 214 of the brittle structure, the assembly of the brittle structure 210 and the connection members 100C (e.g., the portion of the downhole tool) may be exposed to a temperature above the transition temperature (e.g., the austenite finish temperature ($A_f$), or the glass transition temperature ($T_g$)) of the shape memory material such that the connection members 100C transition back to the first state (e.g., the austenitic phase, or the soft solid state, unmodified state).

Figure 12:
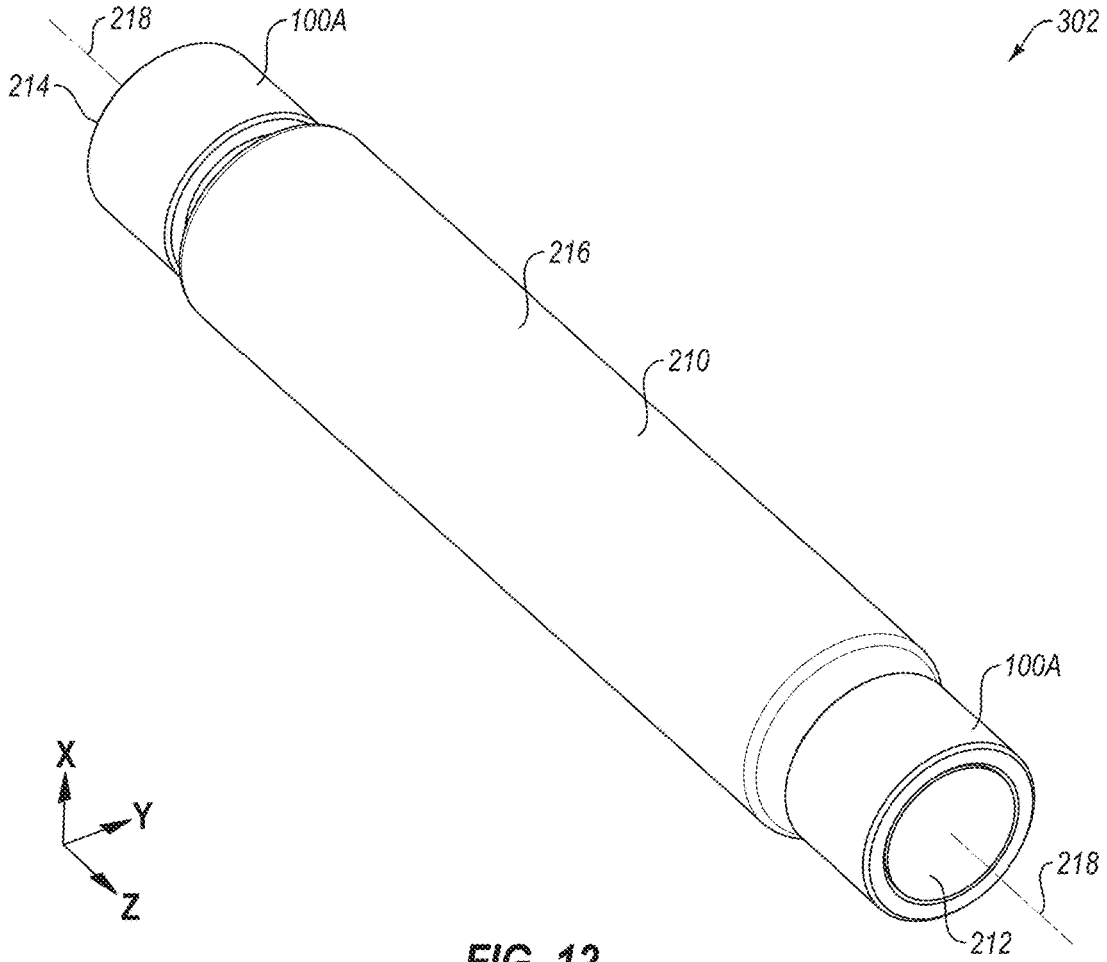
FIG. 12 is a perspective view of a downhole tool component that includes the brittle structure and two of the connection members of FIG. 10, with the connection members in the first state, the unmodified configuration, and secured to the brittle structure, in accordance with embodiments of this disclosure.

FIG. 12 is a perspective view of a downhole tool component 302 that includes the brittle structure 210 and two of the connection members 100A placed on the first and second end portions 212, 214 of the brittle structure 210, in accordance with embodiments of this disclosure. While two connection members 100A are shown in FIG. 12, in additional embodiments, the downhole tool component 302 may include a single connection member 100A on one of the end portions (e.g., the first end portion 212). The connection members 100A are in the first state (e.g., the austenitic phase, or the soft solid state) and the "permanent" or unmodified configuration. The connection members 100C of FIG. 11 may be subjected to heat, such as by placing the brittle structure 210 including one or more of the connection members 100C within an oven at a temperature above the transition temperature (e.g., above the austenite finish temperature ($A_f$), or above the glass transition temperature ($T_g$)). For example, the assembly including the brittle structure 210 and the connection members 100C may be placed in an oven at a temperature of about 200° C. for about 5 minutes or longer. Upon reaching and/or exceeding the austenite finish temperature ($A_f$), the shape memory material of the connection member 100C returns to the first state (e.g., austenitic phase, soft solid state) and the "permanent" or unmodified configuration. As the connection members 100C return to the first state, the size/configuration of the connection members 100C (FIGS. 8 and 9) returns to the size/configuration of the connection members 100A (FIGS. 3-5) to secure the connection members 100A to the brittle structure 210.

Figure 13:
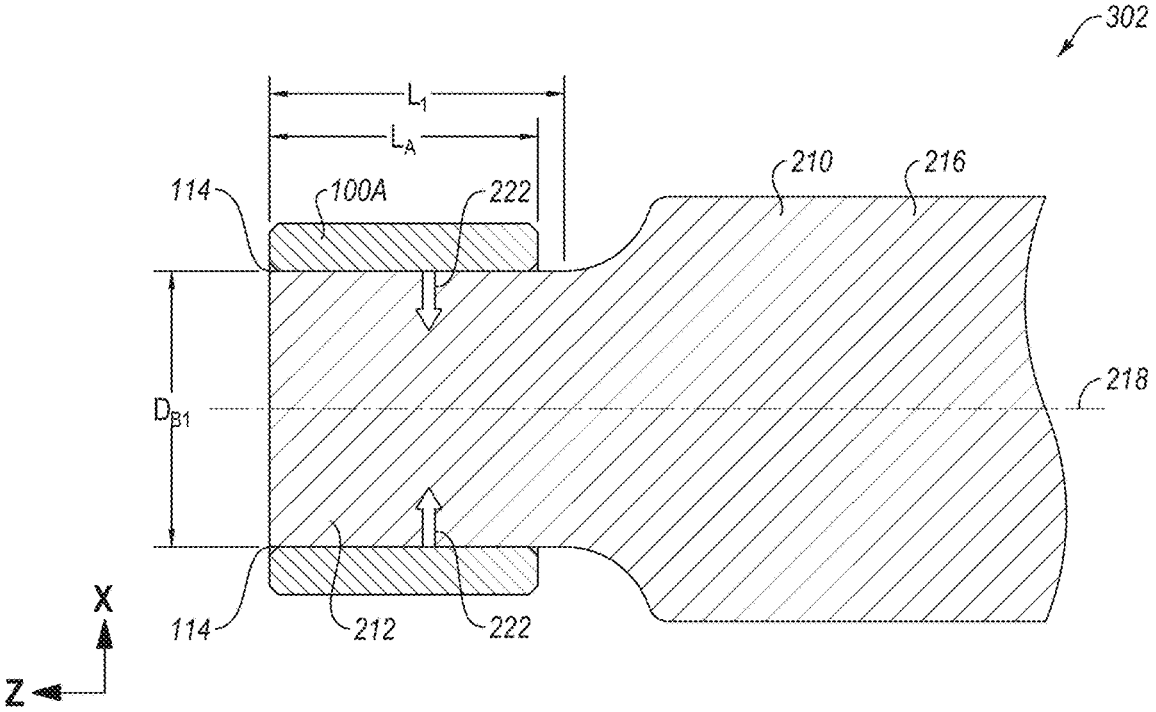
FIG. 13 is a simplified side cross-sectional view of the downhole tool component of FIG. 12 with the connection members secured on corresponding portions of the brittle structure, in accordance with embodiments of this disclosure.

FIG. 13 is a simplified side cross-sectional view of the downhole tool component 302 of FIG. 12 that includes the brittle structure 210 and one of the connection members 100A positioned on the first end portion 212 of the brittle structure 210. The connection member 100A is in the first state (e.g., austenitic, or soft solid state) and the unmodified configuration. The inner diameter ($D_{IC}$) of the opening 106 within the connection member 100C has been reduced, by applying heat, to match the outer diameter ($D_{B1}$) of the first end portion 212 of the brittle structure 210. Thus, the clearance 220 (FIG. 11) between the connection member 100C and the first end portion 212 has been eliminated due to the material expansion of the connection member 100C. In some embodiments, the length ($L_1$) of the first end portion 212 of the brittle structure 210 may be substantially the same as the length $L_A$ of the connection member 100A. In additional embodiments, the length ($L_1$) of the first end portion 212 of the brittle structure 210 may be different than the length $L_A$ of the connection member 100A.

In addition, because the connection member 100A, in the "permanent" or unmodified configuration is biased toward exhibiting an inner diameter ($D_{IA}$) smaller than the outer diameter ($D_{B1}$) of the first end portion 212 of the brittle structure 210, a contact force 222 (holding force) is applied between the outer surface 221 of the first end portion 212 and the interior surface 114 of the connection member 100A (e.g., press fit, without limitation). The contact force 222 or contact pressure between the connection member 100A and the brittle structure 210 may be sufficient to substantially inhibit (e.g., prevent) any axial movement of the connection member 100A relative to the first end portion 212 of the brittle structure 210. For example, the contact force 222 between the connection member 100A and the first end portion 212 of the brittle structure 210 may be within a range of from about 500 Newtons (N) to about 10,000 N (10 kilonewtons (kN)), such as from about 1 kN to about 9 kN, from about 3 kN to about 8 kN, or from about 4 kN to about 7 kN (e.g., about 5 kN, about 5.5 kN, or about 6 kN).

The contact force 222 can be determined by applying an axial force utilizing a tensile testing machine with a capability of applying at least a 10 kN tensile force. Suitable tensile testing machines may be commercially available from Instron® located at 825 University Ave., Norwood, MA, 02062-2643, United States. As a specific non-limiting example, when the connection member 100A comprises a shape memory alloy, and the connection member 100A is at a temperature about 20° C. below the austenite finish temperature ($A_f$) of the shape memory material, the contact force 222 may be about 5.57 kN (i.e., a tensile force of at least 5.57 kN is required to axially separate the connection member 100A from the brittle structure 210). As another specific non-limiting example, when the connection member 100A comprises a shape memory alloy, and the connection member 100A is at a temperature about 150° C. above the austenite finish temperature ($A_f$), the contact force 222 may be greater than 10 kN (i.e., a tensile force of at least 10 kN is required to axially separate the connection member 100A from the brittle structure 210).

Figure 14:
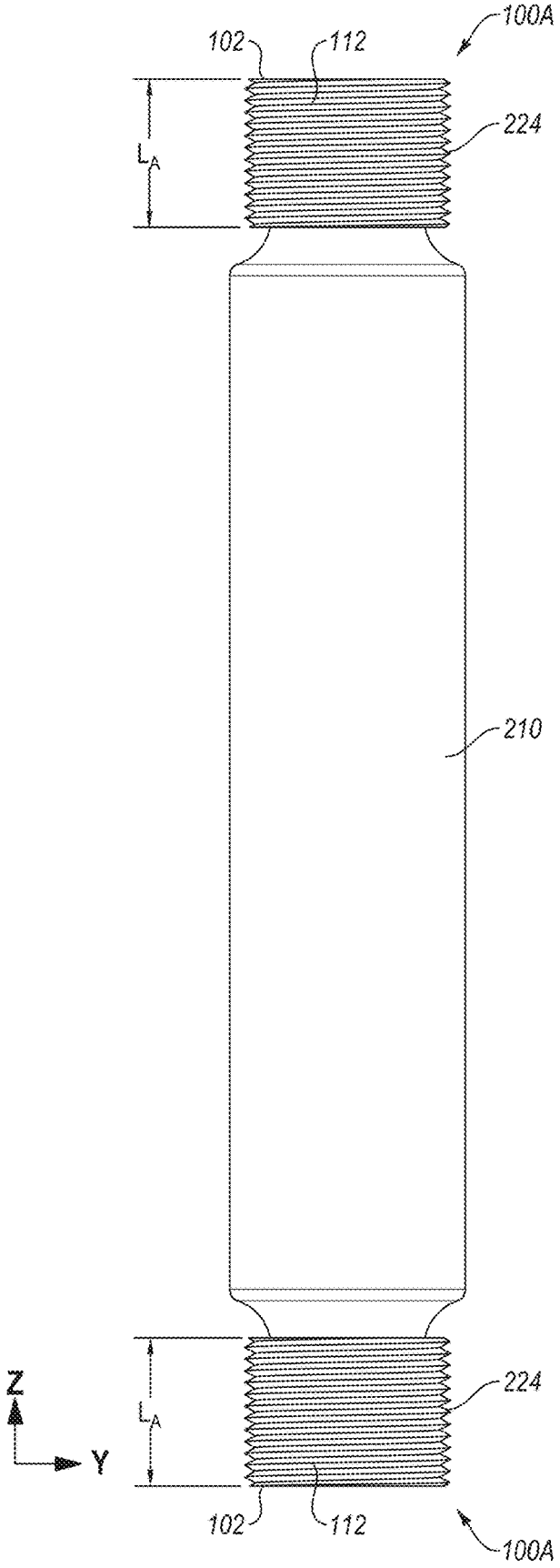
FIG. 14 is a side view of the downhole tool component of FIG. 13 that includes the connection members with connection features, in accordance with embodiments of this disclosure.

Once the connection member(s) 100A are secured to the first and second end portions 212, 214 of the brittle structure 210, the connection member(s) 100A may undergo one or more material removal processes to form a connection feature 224, as shown and described in FIG. 14.

Figure 17:
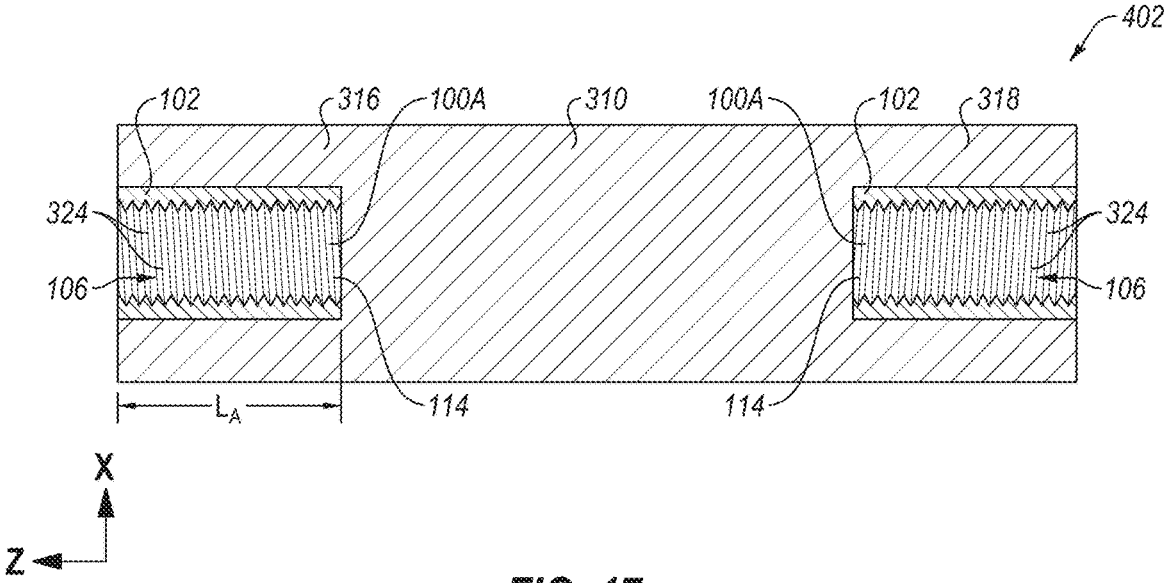
FIG. 17 is a simplified cross-sectional view of the downhole tool component of FIGS. 15 and 16 with connection features on the connection members, in accordance with additional embodiments of this disclosure.

FIG. 14 is a side view of the downhole tool component 302 that includes the connection members 100A with connection features 224, in accordance with embodiments of this disclosure. As will be described in further detail below, in various embodiments, the body 102 includes the connection features 224 formed in the one or more sidewalls 104, such as at an outer surface of the one or more sidewalls 104 as illustrated in FIG. 14 (e.g., external threading, without limitation) or at an inner surface of the one or more sidewalls 104 as illustrated in FIG. 17 (e.g., internal threading, without limitation). In some embodiments, once the connection members 100A are secured to the first and second end portions 212, 214 of the brittle structure 210, the connection members 100A may undergo one or more material removal processes (e.g., machining) to form the connection features 224 on exposed surfaces (e.g., the exterior surfaces 112) of the body 102 of the connection members 100A. Forming the connection features 224 once the connection members 100A are secured to the first and second end portions 212, 214 of the brittle structure 210 may reduce (e.g., eliminate) issues with misalignment between the connection members 100A and the brittle structure 210. However, in additional embodiments, the connection features 224 may be formed on the connection members 100A in the first state (e.g., austenitic or soft solid state) and unmodified or "permanent") configuration before securing the connection members 100A to the brittle structure 210.

Non-limiting examples of processes to form the connection features 224 include drilling, milling, turning, using a die, tapping, etc. The connection features 224 may include ridges and/or grooves, threads, etc. Each connection feature 224 may be configured (e.g., sized, shaped, oriented, and/or arranged) to couple the brittle structure 210 to a corresponding portion of another structure, such as another component of the downhole tool component 302.

The connection feature 224 (e.g., threads) may be on at least a portion of the body 102 of the connection member 100A. In some embodiments, the body 102 of the connection members 100A includes the connection feature 224 (e.g., threads) on only a portion of the exterior surface 112. For example, the body 102 may only include threads on a quartile (e.g., in the Z-direction), a half, or on a three-quarters of the connection members 100A. In additional embodiments, one or more peripheral sections (e.g., circumferential sections) of the connection members 100A may include the connection feature 224, and the connection feature 224 may be absent from intervening peripheral sections. For example, there may be alternating threaded and non-threaded sections arranged around the circumference of the body 102 of the connection members 100A. In some embodiments that include the connection feature 224 on only a portion of the peripheral sections of the connection members 100A, the body 102 of the connection member 100A includes the connection feature 224 (e.g., threads) on an entire length ($L_A$) of the connection member 100A.

In some embodiments, the body 102 of the connection member 100A includes the connection feature 224 (e.g., threads) on the entire exterior surface 112 of the body 102. For example, the connection feature 224 may extend the entire length ($L_A$) on the exterior surface 112 of the body 102, and also extend continuously around the entire periphery (e.g., circumference) of the body 102 of the connection member 100A. While FIGS. 10-14 show and describe the interior surface 114 (FIG. 13) of the connection members 100A as securing to the brittle structure 210, and the connection features 224 on the exterior surface 112 of the connection members 100A, this disclosure is not so limited. In the embodiments shown and described with reference to FIGS. 15-17, the exterior surface 112 of the connection members 100A may be secured within a cavity of the brittle structure 310 (FIG. 15), and the connection feature 224 may be on the interior surface 114 of the connection members 100A.

FIG. 15 is a simplified cross-sectional view of two of the connection members 100C in the second state and the modified configuration, which are positioned within the brittle structure 310, in accordance with additional embodiments of this disclosure. The connection members 100C are in the second state (e.g., martensitic, or hard solid state) and the modified configuration. Because the outer diameter ($D_{OC}$) of the one or more sidewalls 104 (e.g., the exterior surface 112) of the body 102 of the connection member 100C is smaller than the inner diameter ($D_{B2}$) of the inner surface 312 of the cavities 314 within the first end portion 316 and the second end portion 318 of the brittle structure 310, there is clearance 320 between the exterior surface 112 of the connection member 100C and the inner surface 312 of the cavities 314. To remove the clearance 320 and secure the connection members 100C within the first and second end portions 316, 318 of the brittle structure, the connection member(s) 100C or the assembly of the brittle structure 310 and the connection members 100C (e.g., the portion of the downhole tool) may be subjected to a temperature above the transition temperature (e.g., the austenite finish temperature ($A_f$), or the glass transition temperature ($T_g$)) of the shape memory material such that the connection members 100C transition back to the first state (e.g., the austenitic phase, or the soft solid state).

Figure 16:
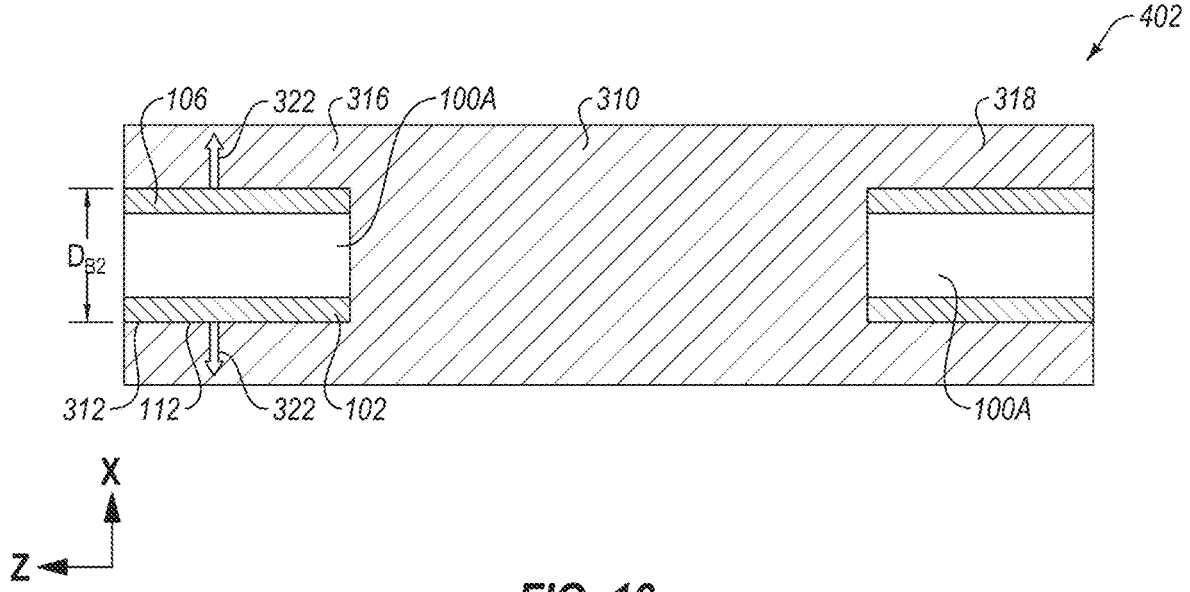
FIG. 16 is a simplified cross-sectional view of the downhole tool component of FIG. 15 that includes the brittle structure and the two connection members of FIG. 10, which are in the first state, the unmodified configuration, and are secured within the brittle structure, in accordance with additional embodiments of this disclosure.

FIG. 16 is a simplified cross-sectional view of the downhole tool component 402 of FIG. 15 that includes the brittle structure 310 and the two connection members 100A, which are in the first state, the unmodified configuration, and are secured within the brittle structure 310, in accordance with additional embodiments of this disclosure. The downhole tool component 402 includes the brittle structure 310 and two of the connection members 100A placed within the cavities 314 of the first and second end portions 316, 318 of the brittle structure 310. While two connection members 100A are shown in FIG. 16, in additional embodiments, the downhole tool component 302 may include a single connection member 100A on one of the end portions (e.g., the first end portion 316). The connection members 100A are in the first state (e.g., the austenitic phase, or the soft solid state) and the "permanent" or unmodified configuration. The connection members 100C of FIG. 15 may be subjected to heat, such as by placing the brittle structure 310 including one or more of the connection members 100C within an oven at a temperature above the transition temperature (e.g., above the austenite finish temperature ($A_f$), or above the glass transition temperature ($T_g$)), or by applying heat to only the connection member(s) 100C. For example, the assembly of the brittle structure 310 and the connection members 100C may be placed in an oven at a temperature of about 200° C. for about 5 minutes or longer. Upon reaching and/or exceeding the austenite finish temperature ($A_f$), the shape memory material of the connection members 100C returns to the first state (e.g., austenitic phase, soft solid state) and the "permanent" or unmodified configuration.

The outer diameter ($D_{OC}$) of the one or more sidewalls 104 of the body 102 of the connection members 100C have increased to match the inner diameter ($D_{B2}$) of the inner surfaces 312 of the cavities 314 of the brittle structure 310. Thus, the clearance 220 (FIG. 15) between the connection member 100C and the first and second end portions 316, 318 has been eliminated due to the material expansion of the connection members 100A. In addition, because the connection members 100A, in the "permanent" or unmodified configuration is biased toward exhibiting an outer diameter ($D_{OA}$) larger than the inner diameter ($D_{B2}$) of the cavities 314 within the first and second end portions 316, 318 of the brittle structure 310, a contact force 322 (holding force) is applied between the inner surface 312 of the cavities 314 and the exterior surface 112 of the connection members 100A. The contact force 322 or contact pressure between the connection member 100A and the brittle structure 310 may be sufficient to substantially inhibit (e.g., prevent) any axial movement of the connection member 100A relative to the first and second end portions 316, 318 of the brittle structure 310. For example, the contact force 322 between the connection member 100A and the first and second end portions 316, 318 of the brittle structure 310 may be within a range of from about 500 Newtons (N) to about 10,000 N (10 kilonewtons (kN)), such as from about 1 kN to about 9 kN, from about 3 kN to about 8 kN, or from about 4 kN to about 7 kN (e.g., about 5 kN, about 5.5 kN, or about 6 kN). Once the connection member(s) 100A are secured to the first and second end portions 316, 318 of the brittle structure 310, the connection member(s) 100A may undergo one or more material removal processes to form a connection feature, as shown and described in FIG. 17. The outer diameter ($D_{OA}$) of connection member 100A defines a surface (surface corresponding to the outer diameter). In the first state and unmodified configuration of connection member 100A, the surface is secured to the inner surface 312 of the brittle structure 310.

FIG. 17 is a simplified cross-sectional view of the downhole tool component 402 of FIGS. 15 and 16 that includes the connection members 100A with connection features 324, in accordance with embodiments of this disclosure. In some embodiments, once the connection members 100A are secured to the first and second end portions 316, 318 of the brittle structure 310, the connection members 100A may undergo one or more material removal processes (e.g., machining) to form the connection features 324 on exposed surfaces (e.g., the interior surfaces 114) of the body 102 of the connection members 100A. Forming the connection features 324 once the connection members 100A are secured to the first and second end portions 316, 318 of the brittle structure 310 may reduce (e.g., eliminate) issues with misalignment between the connection members 100A and the brittle structure 310. However, in additional embodiments, the connection features 324 may be formed on the connection members 100A in the first state (e.g., austenitic or soft solid state) and unmodified or "permanent" configuration before securing the connection members 100A to the brittle structure 310.

Non-limiting examples of processes to form the connection features 324 include drilling, milling, turning, tapping, etc. The connection features 324 may include ridges and/or grooves, threads, etc. Each connection feature 324 may be configured (e.g., sized, shaped, oriented, and/or arranged) to connect the brittle structure 310 to a corresponding portion of another structure, such as another component of the downhole tool component 402.

The connection feature 324 (e.g., threads) may be on at least a portion of the body 102 of the connection member 100A. In some embodiments, the body 102 of the connection members 100A includes the connection feature 324 (e.g., threads) on only a portion of the interior surface 114. For example, the body 102 may only include threads on a quartile (e.g., in the Z-direction), a half, or on a three-quarters of the connection members 100A. In additional embodiments, one or more interior sections (e.g., circumferential sections) of the interior surfaces 114 of the connection members 100A may include the connection feature 324, and the connection feature 324 may be absent from intervening interior sections. For example, there may be alternating threaded and non-threaded sections arranged around the inner surface 312 of the body 102 of the connection members 100A. In some embodiments that include the connection feature 324 on only a portion of the interior sections of the connection members 100A, the body 102 of the connection member 100A includes the connection feature 324 (e.g., threads) on an entire length ($L_A$) of the connection member 100A.

In some embodiments, the body 102 of the connection member 100A includes the connection feature 324 (e.g., threads) on the entire interior surface 114 of the body 102 connection members 100A. For example, the connection feature 224 may extend the entire length ($L_A$) on the interior surface 114 of the body 102, and also extend continuously around the entire interior surface 114 (e.g., circumference) of the opening 106 within the body 102 of the connection member 100A.

In some embodiments, the body 102 of the connection members 100A include connection feature 224 (FIG. 14) on the exterior surface 112, and also include the connection features 324 on the interior surface 114 within the opening 106.

The connection features 224 of the downhole tool component 302 (FIGS. 10-14), and the connection features 324 (FIGS. 15-17) may be configured (e.g., sized, shaped, oriented, and/or arranged) to connect to corresponding portions (e.g., complementary connection features) of an additional structure, such as another component of the respective downhole tools (not shown).

Figure 18:
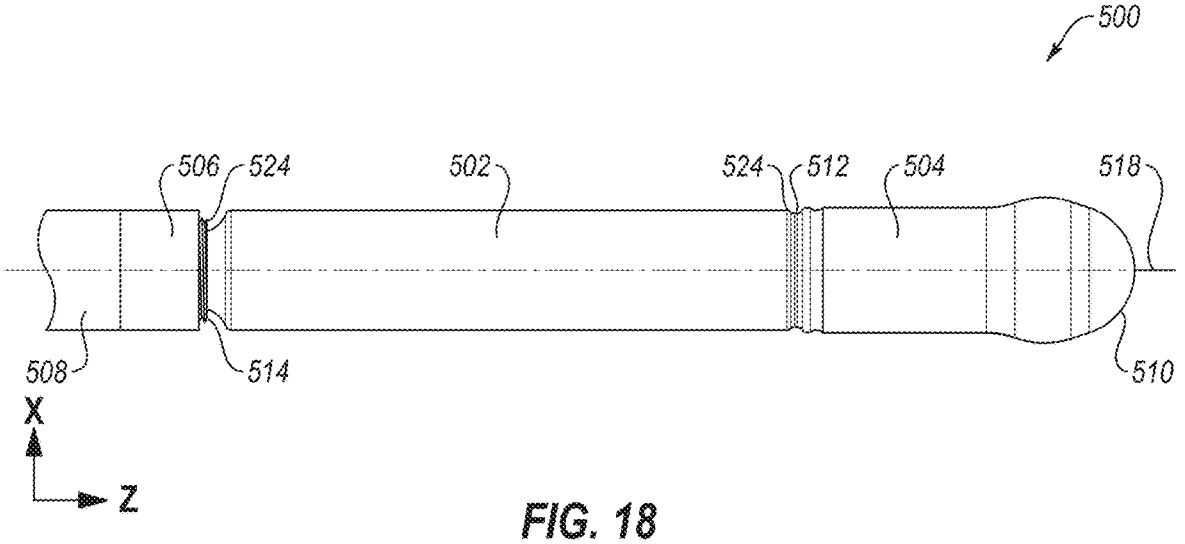
FIG. 18 is a perspective view of a downhole tool that includes additional components connected to the downhole tool of either FIG. 14 or FIG. 17, in accordance with embodiments of this disclosure.

FIG. 18 is a perspective view of a downhole tool 500 that includes additional downhole components connected to the downhole tool component 502 (e.g., 302 (FIGS. 10-14) or the downhole tool component 402 (FIGS. 15-17)), in accordance with embodiments of this disclosure. The downhole tool 500 may be a downhole mud-pulse tool used as part of a downhole telemetry system to provide real-time data to the rig surface (surface unit, outside the borehole), as explained below with reference to FIG. 19. The downhole tool 500 includes the downhole tool component 502 (e.g., the downhole tool component 302, 402) connected to an end cap 504 at a first end 512 of the downhole tool component 502, and an actuator 506 connected at an opposite second end 514 of the downhole tool component 502. For example, the end cap 504 may include a complementary connection feature (e.g., ridges and/or grooves, threads, etc.) connected to the connection feature 524 (e.g., 224, 324) at a first end 512 of the downhole tool component 502. Additionally, the actuator 506 may include a complementary connection feature (e.g., ridges and/or grooves, threads, etc.) connected to the connection feature 524 (e.g., 224, 324) at the opposite second end 514 of the downhole tool component 502. The end cap 504 and the actuator 506 may be made of any suitable materials, such as brittle materials, metals (e.g., steel, Inconel), polymers (e.g., PEEK), etc. In some embodiments, the end cap 504 may include a valve head 510 and may be made of and/or include a brittle material to improve the corrosion and abrasion resistance to the drilling fluid. In addition, the actuator 506 may comprise a tough material, such as a metal (e.g., steel, Inconel, without limitation), to facilitate driving movement while inhibiting the effects of fatigue.

The downhole tool 500 may include one or more additional components 508, such as a battery, a control unit (e.g., a processor and memory), a motor, and one or more sensors (e.g., gamma sensors, gyrometers, accelerometers, magnetometers, etc.).

The downhole tool 500 may be a generally elongated structure arranged along a central longitudinal axis 518 and having a controlled outer diameter such that the downhole tool 500 can fit within the central opening of a drill string component, such as a drill collar. The actuator 506 of the downhole tool 500 may be configured (e.g., sized, shaped, oriented, and/or arranged) to selectively extend and retract the downhole tool component 502 and the end cap 504 relative to a remaining portion of the downhole tool 500 or the drill collar in a direction parallel to the central longitudinal axis 518 of the downhole tool 500 (e.g., in an axial direction). The actuator 506 may be any suitable linear actuator, such as a linkage mechanism (e.g., slider-crank, crank-and-piston, cam-and-follower, etc.), an electric motor, etc.

In addition, the end cap 504 may be positioned within a casing 516 (e.g., a housing, without limitation) (FIG. 6) that includes a nozzle 520 (FIG. 6). When the downhole tool 500 is assembled and in operation, the end cap 504 may be configured (e.g., sized, shaped, oriented, and/or arranged) to extend toward and retract from the nozzle 520 to restrict and expand the flow passage of drilling fluid, which creates pressure waves in the drilling fluid within the drill string. Depending on the drilling conditions, such as the expected drilling fluid pressure in the wellbore, the drilling fluid properties, types of drilling fluid pumps, etc., the end cap 504 may be swapped out with another end cap that is better suited for the specific drilling conditions (e.g., an end cap with a valve head made from a harder material, without limitation). Accordingly, a connection feature 524 (e.g., 224, 324) on the downhole tool component 502 as described herein may facilitate quick and easy assembly and disassembly, as well as the ability to reuse the end cap 504 and other end caps. It will be appreciated that the complementary connection feature at the end cap 504 or the complementary connection feature at the actuator 506 may be applied to the end cap or the actuator in a similar manner as the connection feature 524 is applied to the downhole component 502 by using a shape memory material.

Figure 19:
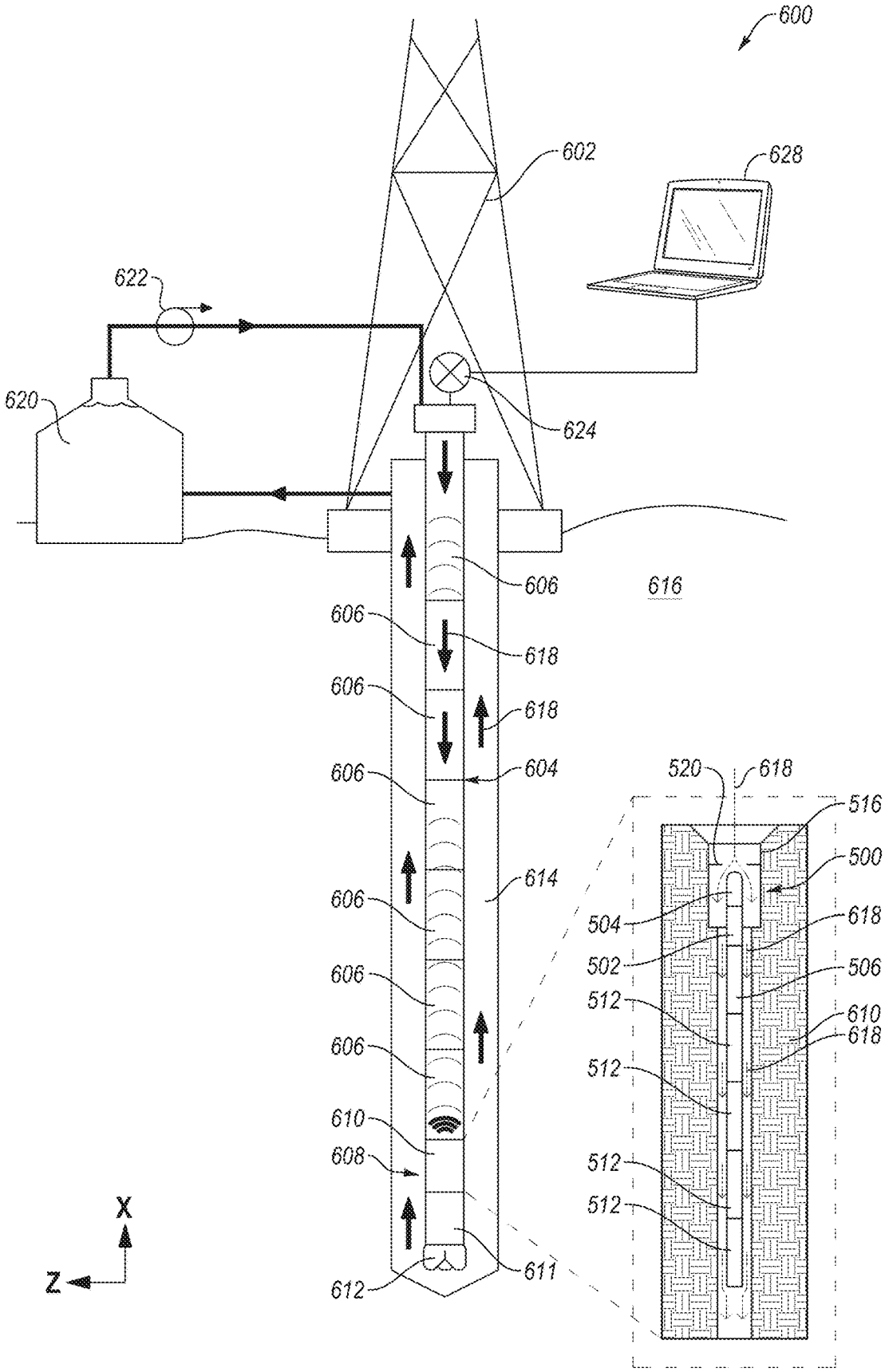
FIG. 19 is a simplified schematic view of an earth-boring system that includes the downhole tool of FIG. 18, in accordance with embodiments of this disclosure.

FIG. 19 shows an earth-boring system 600 that includes a drilling rig 602 suspending a drill string 604. In addition, FIG. 19 includes a partial cross-sectional view of an enlarged portion of the drill string 604.

The drill string 604 has multiple sections of drill pipe 606 connected to one another and a bottom-hole assembly 608 (BHA) connected to the string of the drill pipe 606. The bottom-hole assembly 608 may include one or more drill collars 610, a downhole motor 611, and an earth-boring tool 612 at a downhole end of the drill string 604 that rotates to drill the wellbore 614 within the earth formation 616. Within the drill collars 610 the BHA 608 may include one or more downhole tools 500 that can be used to collect data regarding the formation (e.g., gamma signature) and the drilling process (e.g., inclination, azimuth, depth, etc.), which can then be transmitted real-time to the rig surface.

During the drilling process, drilling fluid 618 (often referred to as "drilling mud") circulates from drilling fluid tanks 620, down the center (inner bore) of the drill string 604, out of jets in the earth-boring tool 612, and back up through the annulus of the wellbore and along the one or more sidewalls of the wellbore 614 back to the drilling fluid tanks 620. For example, pumps 622 may pump the drilling fluid from the drilling fluid tanks 620 down the drill string 604 and at least some of the drilling fluid 618 may return to the drilling fluid tanks 620. The presence of a continuous fluid column within the center of the drill string 604, and the incompressibility of fluid enables pressure waves generated via "mud-pulse" downhole tools to be detected via a pressure transducer 624 on the drilling rig 602. The detected pressure wave signals (e.g., binary-signal pressure waves) can then be decoded via surface computer equipment 628 (e.g., included in a surface unit, without limitation) to determine the data regarding the formation (e.g., gamma signature) and the drilling process (e.g., inclination, azimuth, depth, etc.) that has been gathered by the downhole tools 500.

To generate the pressure waves, the end cap 504 may extend toward and retract from a nozzle 520 (e.g., an orifice, or restrictor) within the downhole tool 500 to create pressure waves that travel up the fluid column within the drill string 604 and are detected by the pressure transducer 624 and decoded by the surface computer equipment 628.

The mud-pulse downhole tool or any other downhole valve for manipulating the flow of a downhole fluid, which comprises abrasive materials in a high temperature environment, such as present in a typical borehole with temperatures greater than 150° C., benefit from connections made in accordance with embodiments of this disclosure. In an alternative embodiment, a valve head as used in the mud-pulse tool (FIG. 19) may utilize a connection including a connection member, such as any embodiment of the connection member disclosed herein.

Figure 20:
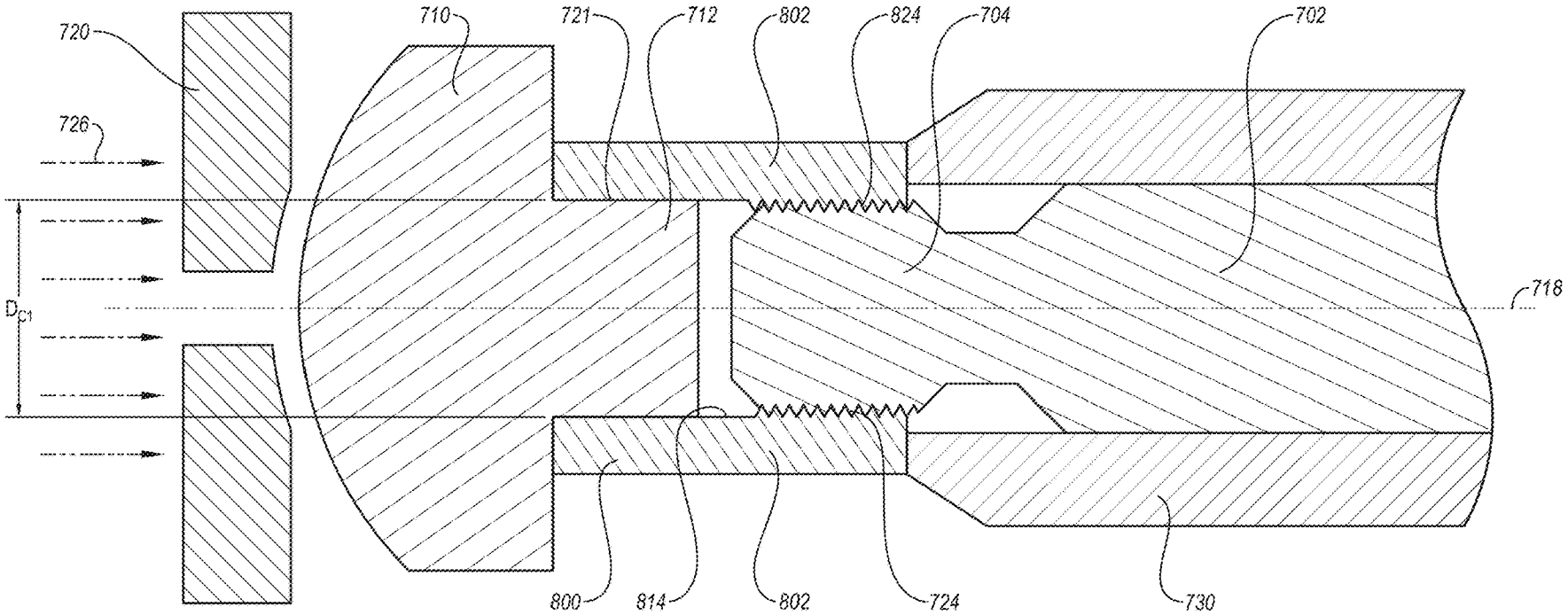
FIG. 20 is a simplified side cross-sectional view of a plunger system.

FIG. 20 is a simplified side cross-sectional view of a plunger system 701. The plunger system comprises valve head 710 and a downhole component, such as a shaft or rod 702. The rod 702 may be made from steel or any other suitable material and may be surrounded by a guiding feature 730. The rod 702 may be moved by an actuator (not shown) to move the valve head 710 in a reciprocating manner relative to a restrictor 720 (e.g., a valve seat, or a nozzle). The valve head 710 includes an end portion 712 and may be made from a brittle material (ceramics, hard metal, glass, graphite, etc.) to make the valve head resistive to abrasion when exposed to a downhole fluid 726 hitting the valve head and flowing along the valve head. The end portion 712 of the valve head 710 may possess a cylindrical shape and a circular cross section in a plane perpendicular to a longitudinal axis 718 of the end portion. A connection member 800 (shown in the first state) includes a body 802, and one or more sidewalls defining an opening. The connection member 800 connected to the end portion 712 of the valve head 710. The connection member 800 may be made from a shape memory alloy or a shape memory polymer. The connection member 800 in FIG. 20 is shown in a first state (e.g., the austenitic phase, or the soft solid state) and "permanent" or unmodified configuration in accordance with embodiments of this disclosure. According to the process described in FIGS. 6-9 the connection member 800 went through an expansion procedure while in the second state of the shape memory alloy (e.g., martensitic, or hard solid state) (FIG. 8) to increase the inner diameter of the connection member 800 to achieve the modified configuration (FIG. 9) of the second state. The connection member 800, while in the second state and in the modified configuration comprises an inner diameter larger than the outer diameter $D_{C1}$ of the end portion 712 of the valve head 710 (refer to FIGS. 8-11 for similar configurations), allowing to move the connection member 800 in the second state and modified configuration relative to the end portion 712 and position the connection member 800 on or at the end portion 712. After heating the connection member 800 above the austenite finish temperature, the connection member transitions to the austenitic phase and the unmodified configuration, resulting in an interference fit (contact force) with an outer surface 721 of the end portion 712 of the valve head 710. The interference fit secures the connection member 800 on the end portion 712 of the valve head 710. A connection feature 824 (e.g., threads, grooves, ridges) is formed on an interior surface 814 of the body 802. The connection feature 824 may be configured (e.g., sized, shaped, oriented, and/or arranged) to couple the valve head 710 to a corresponding portion of the rod 702. The corresponding portion of the rod 702 may be an end portion 704 of the rod and may include a complementary connection feature 724 (e.g., threads, grooves, ridges) configured to connect to the connection feature 824 on the connection member 800 providing a connection between the valve head 710 and the rod 702 so that the valve had is moved with the rod when the rod is moved by the actuator. The plunger system 701 may be located in a pulser housing (not shown) similar to the casing displayed in FIG. 19. A fluid flow passes through the pulser housing and the restrictor 720. With moving the valve head 710 with the rod 702 driven by the actuator towards the restrictor 720, a pressure pulse is generated in the downhole fluid 726 flowing though the pulser housing and the inner bore of the drill string or BHA (FIG. 19). The pressure pulse allowing to transmit information from a location inside the borehole to a surface location (surface unit) outside the borehole at the earth surface. In an alternative embodiment, the connection between a valve head made from a brittle material and another downhole component is not limited to a mud-pulse tool, but may be utilized in other types of downhole valves, such as, for example, a flow stop valve or a flow diverter valve. In some embodiments, a gap is present between the rod 702 and the valve head 710. In other embodiments, the rod 702 abuts the valve head 710.

Figure 21:
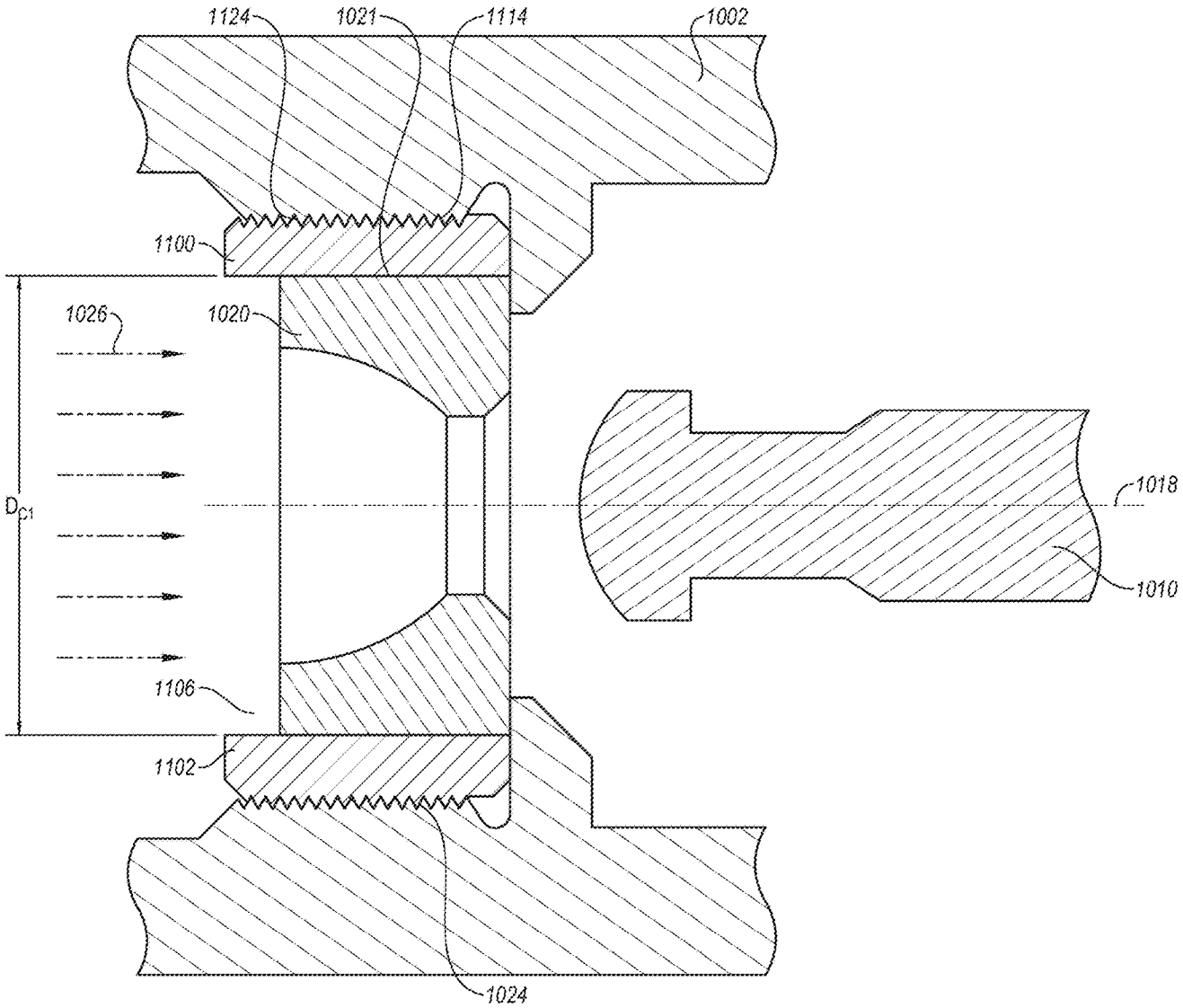
FIG. 21 is a simplified side cross-sectional view of another embodiment of a portion of a bottom-hole assembly of FIG. 19 in accordance with embodiments of this disclosure.

FIG. 21 is a simplified side cross-sectional view of another embodiment of a portion of a BHA of FIG. 19 in accordance with embodiments of this disclosure. A restrictor 1020 of a mud-pulse tool (FIG. 19) is exposed to abrasion due to downhole fluid 1026 flowing at high flow rates through a restrictor. Manufacturing a restrictor from a material that can withstand degradation through abrasive downhole fluids, such as a ceramics material or a hard metal, glass or graphite may be beneficial. These materials are brittle, which may prevent a connection feature (e.g., threads, grooves, ridges) to be formed in the brittle material thereof to achieve a direct connection of a restrictor with other components of the mud pulser, such as a housing. Using a shape memory alloy or shape memory polymer to place a thread formed on a connection member 1100 on a restrictor resolves the problem. The restrictor 1020 may include a cylindrical shape and a circular cross section perpendicular to the longitudinal axis 1018 of the restrictor. In various embodiments, the connection member 1100 includes a body 1102, an outer surface 1114, and one or more sidewalls that define an opening 1106. The connection member 1100 is connected to the restrictor 1020. The connection member 1100 may be made from a shape memory material. In various embodiments, the shape memory material is chosen from among a shape memory alloy and a shape memory polymer.

The connection member 1100 in FIG. 21 is shown in a first state (e.g., the austenitic phase, or the soft solid state) and "permanent" or unmodified configuration in accordance with embodiments of this disclosure. According to the process described in FIGS. 6-9 the connection member 1100 went through an expansion procedure while in the second state of the shape memory alloy (e.g., martensitic, or hard solid state) (FIG. 8) to increase an inner diameter of the connection member 1100 to achieve the modified configuration (FIG. 9) of the second state. The connection member 1100 in the second state and the modified configuration comprises an inner diameter larger than the outer diameter $D_{D1}$ of the restrictor 1020 (refer to FIGS. 8-11 for similar configurations), allowing to move the connection member 1100 relative to the restrictor 1020 and position the connection member 1100 on or at the restrictor. After heating the connection member above the austenite finish temperature, the connection member transitions to the austenitic phase and the unmodified configuration resulting in an interference fit (contact force) with an outer surface 1021 of the restrictor 1020. The interference fit secures the connection member 1100 on the restrictor 1020. A connection feature 1124 (e.g., threads, grooves, ridges) is formed on an outer surface 1114 of the body 1102 of the connection member 1100. The connection feature 1124 may be configured (e.g., sized, shaped, oriented, and/or arranged) to couple the restrictor 1020 to a corresponding portion of a housing 1002. The corresponding portion of the housing 1002 may include a complementary connection feature 1024 (e.g., threads, grooves, ridges) configured to connect to the connection feature 1124 on the connection member 1100 resulting in a connection of the restrictor 1020 to the housing 1002 so that the restrictor is fixedly connected to the housing by connection features 1024 and 1124. The housing 1002 may be similar to the casing displayed in FIG. 19 or may be a different housing within the BHA. In one embodiment, housing 1002 may be a drill collar. With moving a valve head 1010 driven by an actuator (not shown) towards the restrictor 1020 a pressure pulse in the downhole fluid 1026 flowing through the restrictor 1020 and the inner bore of the drill pipe and/or the BHA (FIG. 19) is generated, allowing to transmit information from a location inside the borehole to a surface location (surface unit) outside the borehole at the earth surface.

Figure 22:
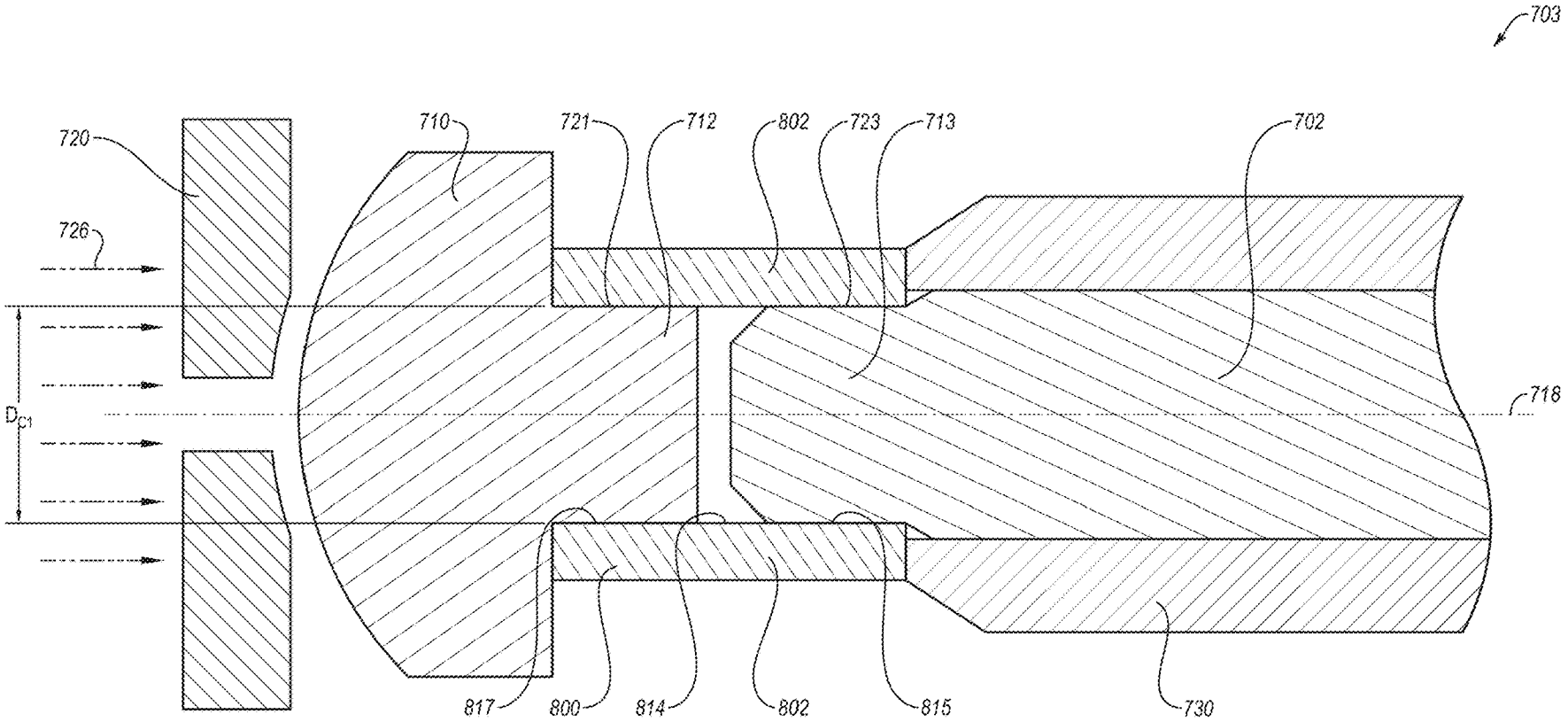
FIG. 22 is a simplified side cross-sectional view of another embodiment of the plunger system of FIG. 20.

FIG. 22 is a simplified side cross-sectional view of another embodiment of the plunger system 701 of FIG. 20. In various embodiments, the interior surface of the connection member 800, as illustrated in FIG. 22, includes a first corresponding surface 815 and a second corresponding surface 817. The first corresponding surface 815 connects the connection member 800 to the end portion 713 of the rod 702 via an interference fit with an outer surface 723 thereof, and the second corresponding surface 817 connects the connection member 800 to the end portion 712 of the valve head 710 via an interference fit with an outer surface 721 thereof. The inner diameter of the first corresponding surface 815 and the second corresponding surface 817 may be substantially the same (as illustrated in FIG. 22) or may be different, corresponding to the outer surfaces of the end portion 713 and the end portion 712, respectively.

In various embodiments, the connection between the connection member 800 to the end portion 713 of the rod 702 is provided by the same method used to connect connection member 800 to the end portion 712 of valve head 710. In particular, the connection member 800 is positioned on an end portion 713 of the rod 702 while in the second state (e.g., martensitic phase, without limitation) and the modified configuration. After applying a stimulus to the connection member 800 (e.g., heating the connection member 800 above the austinite finish temperature), the connection member 800 transitions to the first state (e.g., austenitic phase, without limitation) and the unmodified configuration, resulting in an interference fit (outer interference fit) with an outer surface 723 of the end portion 713 of the rod 702. The interference fit between the connection member 800 and the end portion 713 of the rod 702 may be formed via the first corresponding surface 815 on the connection member 800, and the interference fit between the connection member 800 and the end portion 712 of the valve head 710 may be formed via the second corresponding surface 817 on the connection member 800.

In yet another embodiment, the connection member 800 may connect the valve head 710 and the rod 702 by increasing its outer diameter while transitioning from the second state (e.g., martensitic phase, without limitation) and modified configuration to the first state (e.g., austenitic phase, without limitation) and unmodified configuration as described above with regards to the embodiments shown in FIGS. 15 and 16. In this embodiment, the end portion 712 of the valve head 710 and the end portion 713 of the rod 702 each comprises a cavity (refer to FIGS. 15 and 16) with an inner diameter ($D_{B2}$ FIG. 15). In the second state (e.g., martensitic phase, without limitation) and modified configuration, the outer diameter ($D_{OC}$ FIG. 15) of the connection member 800 is smaller than the inner diameter of the cavity in both the valve head 710 and the rod 702 allowing to position the connection member 800 in each respective cavity. After applying a stimulus to the connection member 800 (e.g., heating the connection member 800 above the austinite finish temperature, without limitation), the connection member 800 transitions to the first state (e.g., austenitic phase, without limitation) and the unmodified configuration, resulting in an interference fit (inner interference fit) with an inner surface of each respective cavity of the valve head 710 and the rod 702. As one can appreciate, the connection between the valve head 710 and the rod 702 may be formed with the connection member 800 by using any combination of the various inner interference fits disclosed herein. For example, the connection member 800 and one of the valve head 710 and the rod 702 connect via an outer interference fit and the connection member 800 and the other of the valve head 710 and the rod 702 connect via an inner interference fit. In some embodiments, a gap is present between the rod 702 and the valve head 710. In other embodiments, the rod 702 abuts the valve head 710.

In an alternative embodiment, the connection between the restrictor 1020 made from a brittle material and another downhole component (e.g., a housing) is not limited to a mud-pulse tool but may be utilized in other types of downhole valves, such as, for example, a flow stop valve or a flow diverter valve. The shape memory material connection members of the embodiments described above are expected to facilitate connections between brittle materials (e.g., glass, ceramics, hard metal, graphite, etc.) and tough, ductile materials (e.g., metals) or any other material (including other brittle materials). Thus, brittle materials that are generally durable in terms of high hardness, resistant to erosion, corrosion, and abrasion, and also lightweight due to a relatively low density may still be utilized for their advantageous material properties while allowing for easy connections with other downhole components. Furthermore, the use of shape memory material may facilitate more imprecise dimensions of the brittle structures due to the ability to expand and constrict in response to a stimulus, such as temperature or stress. In addition, mechanical connections, such as tapered shafts with wide outer ends, or stepped features may be utilized to further secure the connection members because of the high degree of expansion due to the state change.

Further, the ability to machine shape memory material connection members to form connection features, such as threads, once the shape memory connection members are secured onto or within a brittle structure may reduce (e.g., eliminate) issues with misalignment due to combining separable components.

While this shape memory connection members described herein provides advantages to downhole tools for drilling operations, the shape memory connection members may be utilized in any context in which it may be advantageous to secure a connection member onto another downhole component.

Accordingly, it would be desirable to have connection members, downhole tools including the connection members and methods of forming and using the connection members and the downhole tools facilitating assembly and mismatch between materials due to material properties, when compared to conventional downhole tools, and conventional methods of forming and using the conventional connection members and the conventional downhole tools.

While embodiments of the disclosure have been described and illustrated herein with respect to specific connection members, downhole tools and methods, those of ordinary skill in the art will recognize and appreciate that features and elements from different embodiments may be combined to arrive at further, additional connection members, downhole tools and methods as contemplated by the inventors.

Embodiments of this disclosure may be further characterized, without limitation, as set forth below.

Embodiment 1: A downhole valve system for use in a borehole, the downhole valve system comprising: a first downhole component made from a brittle material and including a longitudinal axis; a second downhole component including a first connection feature; and a connection member formed from a shape memory material and comprising: an outer surface including an outer diameter; an inner surface including an inner diameter, one of the outer diameter and the inner diameter modifiable by applying a stimulus to the shape memory material; and a second connection feature, complimentary of the first connection feature, formed on one of the outer surface and the inner surface, the connection member secured to the first downhole component at a corresponding surface of the one of the inner diameter and the outer diameter and to the second downhole component via the first connection feature and the second connection feature to connect the second downhole component to the first downhole component.

Embodiment 2: The downhole valve system according to Embodiment 1, wherein the first downhole component comprises a fracture toughness $K_{1C}$ lower than 20 $MPa \cdot m^{1/2}$.

Embodiment 3: The downhole valve system according to any of Embodiments 1 and 2, wherein the first downhole component includes a valve head positioned within the downhole valve system to be exposed to a downhole fluid during operation thereof.

Embodiment 4: The downhole valve system according to any of Embodiments 1 through 3, wherein the first downhole component includes a restrictor positioned within the downhole valve system to be exposed to a downhole fluid during operation thereof.

Embodiment 5: The downhole valve system according to any of Embodiments 1 through 4, wherein the downhole valve system is chosen from among a downhole mud pulser, a flow diverter valve, and a downhole flow stop valve.

Embodiment 6: The downhole valve system according to any of Embodiments 1 through 5, wherein the shape memory material is modifiable between a first state and a second state by applying the stimulus, the connection member comprising a smaller inner diameter while in the first state than the inner diameter in the second state.

Embodiment 7: The downhole valve system according to any of Embodiments 1 through 6, wherein the shape memory material comprises a nickel-titanium-niobium alloy (NiTiNb).

Embodiment 8: The downhole valve system according to any of Embodiments 1 through 7, wherein the connection member is secured to the first downhole component at the corresponding surface of the one of the inner diameter and the outer diameter via an interference fit.

Embodiment 9: The downhole valve system according to any of Embodiments 1 through 8, wherein the first connection feature comprises threads.

Embodiment 10: The downhole valve system according to any of Embodiments 1 through 9, wherein the brittle material is chosen from among a ceramic and a hard metal.

Embodiment 11: A downhole valve system for use in a borehole, the downhole valve system comprising: a first downhole component made from a brittle material and including a longitudinal axis; a second downhole component; and a connection member formed from a shape memory material comprising: an outer surface including an outer diameter; and an inner surface including an inner diameter, one of the outer diameter and the inner diameter modifiable by applying a stimulus to the shape memory material; the connection member secured to the first downhole component at a first corresponding surface of the one of the inner diameter and the outer diameter, and the connection member secured to the second downhole component at a second corresponding surface of the one of the inner diameter and the outer diameter to connect the second downhole component to the first downhole component.

Embodiment 12: The downhole valve system according to Embodiment 11, wherein the first downhole component is chosen from among a valve head and a restrictor positioned within the downhole valve system to be exposed to a downhole fluid during operation thereof.

Embodiment 13: A method of forming a downhole tool, the method comprising: providing a first downhole component made from a brittle material and including a longitudinal axis and a second downhole component including a first connection feature; and connecting the second downhole component to the first downhole component with a connection member formed from a shape memory material and comprising: an outer surface including an outer diameter; an inner surface including an inner diameter, one of the inner diameter and the outer diameter modifiable by applying a stimulus to the shape memory material; and a second connection feature, complimentary of the first connection feature, formed on one of the outer surface and the inner surface, the connection formed by securing the connection member to the first downhole component at a corresponding surface of the one of the inner diameter and the outer diameter and connecting the connection member to the second downhole component via the first connection feature and the second connection feature to connect the second downhole component to the first downhole component.

Embodiment 14: The method according to Embodiment 13, wherein the first downhole component comprises a fracture toughness $K_{1C}$ lower than 20 $MPa \cdot m^{1/2}$.

Embodiment 15: The method according to any of Embodiments 13 and 14, wherein the first downhole component includes a valve head positioned within a downhole valve system to be exposed to a downhole fluid during operation thereof.

Embodiment 16: The method according to any of Embodiments 13 through 15, wherein the first downhole component includes a restrictor positioned within a downhole valve system to be exposed to a downhole fluid during operation thereof.

Embodiment 17: The method according to any of Embodiments 13 through 16, wherein the shape memory material is modifiable between a first state and a second state by applying the stimulus, and connecting the second downhole component to the first downhole component with a connection member includes arranging the connection member relative to the first downhole component while in the second state, applying the stimulus to the shape memory material to modify the shape memory material from the second state to the first state and secure the connection member to the first downhole component.

Embodiment 18: The method according to any of Embodiments 13 through 17, wherein the shape memory material comprises a nickel-titanium-niobium alloy (NiTiNb).

Embodiment 19: The method according to any of Embodiments 13 through 18, wherein securing the connection member to the first downhole component includes forming an interference fit.

Embodiment 20: The method according to any of Embodiments 13 through 19, wherein the first connection feature and the second connection feature each comprise threads and the connection between the connection member and the second downhole component is formed by threading the first connection feature to the second connection feature.

What is claimed is:

1. A downhole valve system for use in a borehole, the downhole valve system comprising:

a first downhole component made from a brittle material and including a longitudinal axis, the first downhole component comprises a fracture toughness $K_{1C}$ lower than 20 $MPa \cdot m^{1/2}$;

a second downhole component including a first connection feature; and a connection member formed from a shape memory material and comprising: an outer surface including an outer diameter; an inner surface including an inner diameter, one of the outer diameter and the inner diameter modifiable by applying a stimulus to the shape memory material; and a second connection feature, complimentary of the first connection feature, formed on one of the outer surface and the inner surface, the connection member secured to the first downhole component at a corresponding surface of the one of the inner diameter and the outer diameter and to the second downhole component via the first connection feature and the second connection feature to connect the second downhole component to the first downhole component.

2. The downhole valve system of claim 1, wherein the first downhole component includes a valve head positioned within the downhole valve system to be exposed to a downhole fluid during operation thereof.

3. The downhole valve system of claim 1, wherein the first downhole component includes a restrictor positioned within the downhole valve system to be exposed to a downhole fluid during operation thereof.

4. The downhole valve system of claim 1, wherein the downhole valve system is chosen from among a downhole mud pulser, a flow diverter valve, and a downhole flow stop valve.

5. The downhole valve system of claim 1, wherein the shape memory material is modifiable between a first state and a second state by applying the stimulus, the connection member comprising a smaller inner diameter while in the first state than the inner diameter in the second state.

6. The downhole valve system of claim 5, wherein the shape memory material comprises a nickel-titanium-niobium alloy (NiTiNb).

7. The downhole valve system of claim 5, wherein the connection member is secured to the first downhole component at the corresponding surface of the one of the inner diameter and the outer diameter via an interference fit.

8. A method of forming a downhole tool, the method comprising:

providing a first downhole component made from a brittle material and including a longitudinal axis, the first downhole component comprises a fracture toughness $K_{1C}$ lower than 20 MPa·m$^{1/2}$, and a second downhole component including a first connection feature; and connecting the second downhole component to the first downhole component with a connection member formed from a shape memory material and comprising: an outer surface including an outer diameter; an inner surface including an inner diameter, one of the inner diameter and the outer diameter modifiable by applying a stimulus to the shape memory material; and a second connection feature, complimentary of the first connection feature, formed on one of the outer surface and the inner surface, the connection formed by securing the connection member to the first downhole component at a corresponding surface of the one of the inner diameter and the outer diameter and connecting the connection member to the second downhole component via the first connection feature and the second connection feature to connect the second downhole component to the first downhole component.

9. The method of claim 8, wherein the first downhole component includes a valve head positioned within a downhole valve system to be exposed to a downhole fluid during operation thereof.

10. The method of claim 8, wherein the first downhole component includes a restrictor positioned within a downhole valve system to be exposed to a downhole fluid during operation thereof.

11. The method of claim 8, wherein the shape memory material is modifiable between a first state and a second state by applying the stimulus, and connecting the second downhole component to the first downhole component with a connection member includes arranging the connection member relative to the first downhole component while in the second state, applying the stimulus to the shape memory material to modify the shape memory material from the second state to the first state and secure the connection member to the first downhole component.

12. The method of claim 11, wherein the shape memory material comprises a nickel-titanium-niobium alloy (NiTiNb).

13. The method of claim 11, wherein securing the connection member to the first downhole component includes forming an interference fit.

14. The method of claim 8, wherein the first connection feature and the second connection feature each comprise threads and the connection between the connection member and the second downhole component is formed by threading the first connection feature to the second connection feature.

15. The method of claim 8, wherein the brittle material is chosen from among a ceramic and a hard metal.

16. A downhole valve system for use in a borehole, the downhole valve system comprising:

a first downhole component made from a brittle material and including a longitudinal axis;

a second downhole component including a first connection feature, the first connection feature comprising threads; and a connection member formed from a shape memory material and comprising: an outer surface including an outer diameter; an inner surface including an inner diameter, one of the outer diameter and the inner diameter modifiable by applying a stimulus to the shape memory material; and a second connection feature, complimentary of the first connection feature, formed on one of the outer surface and the inner surface, the connection member secured to the first downhole component at a corresponding surface of the one of the inner diameter and the outer diameter and to the second downhole component via the first connection feature and the second connection feature to connect the second downhole component to the first downhole component.

17. The downhole valve system of claim 16, wherein the first downhole component includes a valve head positioned within the downhole valve system to be exposed to a downhole fluid during operation thereof.

18. The downhole valve system of claim 16, wherein the first downhole component includes a restrictor positioned within the downhole valve system to be exposed to a downhole fluid during operation thereof.

19. A downhole valve system for use in a borehole, the downhole valve system comprising:

a first downhole component made from a brittle material and including a longitudinal axis, the brittle material being chosen from among a ceramic and a hard metal;

a second downhole component including a first connection feature; and a connection member formed from a shape memory material and comprising: an outer surface including an outer diameter; an inner surface including an inner diameter, one of the outer diameter and the inner diameter modifiable by applying a stimulus to the shape memory material; and a second connection feature, complimentary of the first connection feature, formed on one of the outer surface and the inner surface, the connection member secured to the first downhole component at a corresponding surface of the one of the inner diameter and the outer diameter and to the second downhole component via the first connection feature and the second connection feature to connect the second downhole component to the first downhole component.

20. The downhole valve system of claim 19, wherein the first downhole component includes a valve head positioned within the downhole valve system to be exposed to a downhole fluid during operation thereof.

* * * * *